US009458848B2

(12) United States Patent
Dreiman

(10) Patent No.: US 9,458,848 B2
(45) Date of Patent: Oct. 4, 2016

(54) REVOLVING PISTON ROTARY COMPRESSOR WITH STATIONARY CRANKSHAFT

(71) Applicant: Nelik I. Dreiman, Tipton, MI (US)

(72) Inventor: Nelik I. Dreiman, Tipton, MI (US)

( * ) Notice: Subject to any disclaimer, the term of this patent is extended or adjusted under 35 U.S.C. 154(b) by 285 days.

(21) Appl. No.: 14/450,215

(22) Filed: Aug. 2, 2014

(65) Prior Publication Data

US 2016/0032925 A1 Feb. 4, 2016

(51) Int. Cl.

| | |
|---|---|
| ***F04C 2/344*** | (2006.01) |
| ***F04C 18/02*** | (2006.01) |
| ***F04C 23/00*** | (2006.01) |
| ***F04C 29/02*** | (2006.01) |
| ***F04C 29/12*** | (2006.01) |

(52) U.S. Cl.

CPC ..... *F04C 18/0215* (2013.01); *F04C 2/344* (2013.01); *F04C 23/005* (2013.01); *F04C 23/008* (2013.01); *F04C 29/026* (2013.01); *F04C 29/122* (2013.01)

(58) Field of Classification Search

CPC .. F04C 18/0215; F04C 2/344; F04C 29/026; F04C 29/122; F04C 23/008; F04C 23/005; F04C 2/348

See application file for complete search history.

*Primary Examiner* — Peter J Bertheaud
*Assistant Examiner* — Dnyanesh Kasture

(57) ABSTRACT

A revolving piston rotary compressor comprises, in combination, the following: a compressor pump; an internal suction gas delivery system which eliminates an external accumulator, excludes a direct distribution of a refrigerant to the suction chamber and performs double-stage liquid-gas separation to prevent slugging, provides cooling of the motor and supercharges refrigerant into suction chamber due to action of an impeller; a discharge system utilizing a tubular discharge valve, a circular expansion cavity equipped with a plurality of reaction nozzles through which the discharge gas is jets ejected rearwards relatively to the intended direction of the revolving piston assembly rotation, said jets that impart driving moment which supplements the main momentum; a lubricating oil delivery system employing a positive displacement oil pump, an oil reservoir formed in the crankshaft and a plurality of oil accumulated annular pockets which prevent formation of "gas lock" condition and accelerate delivery of oil to the bearing and mating surfaces, said oil which will not only lubricate, but will also prevents leakage through the clearances by providing liquid seal with combine pressure-discharge pressure, pumping pressure and pressure developed due to centrifugal forces. An external rotor electric motor of the compressor has been integrated with a pump parts to form the compressor pump arranged on a stationary crankshaft and surrounding by a housing fixed to opposite ends of the crankshaft and having no another contacts with the pump. A stator of the motor is permanently fixed on the stationary crankshaft and the compressor pump components—a rotor block and an eccentrically fit revolving piston assembly are unidirectional spinning around the crankshaft. The rotor block and the revolving piston assembly have no radial clearance internal line contact through which the rotor block transfers an angular moment to the revolving piston assembly. It is not only supplements main momentum transferred to the revolving piston through a rigidly fixed in it vane, but also reduces frictional losses and eliminates leakage losses at the line of contact.

20 Claims, 10 Drawing Sheets

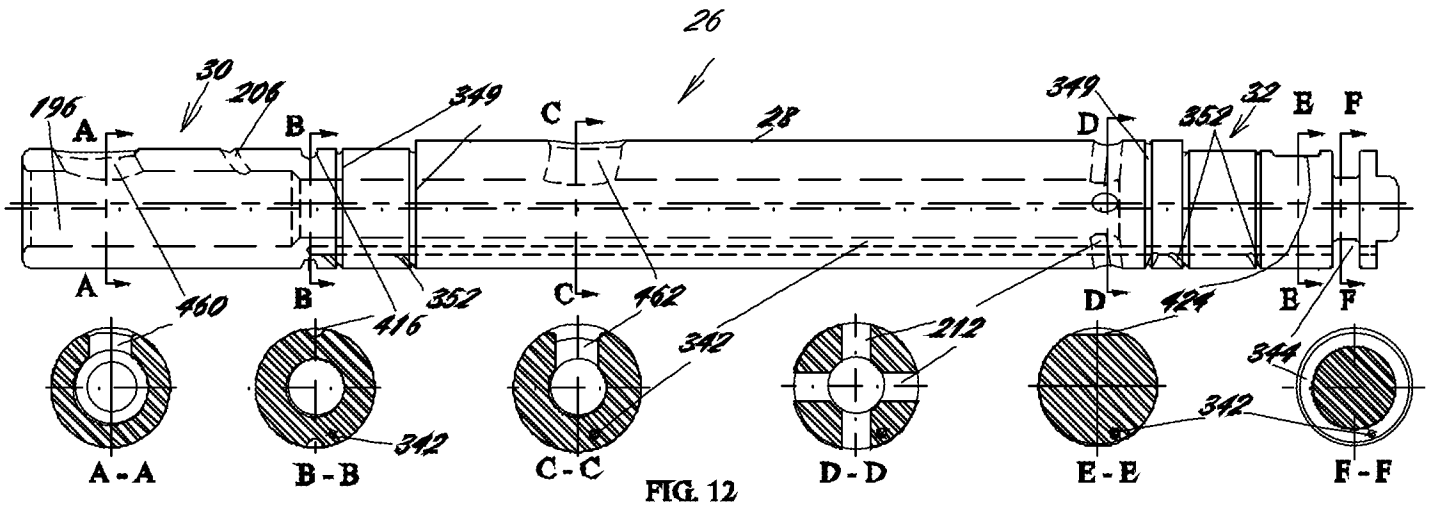
FIG. 12
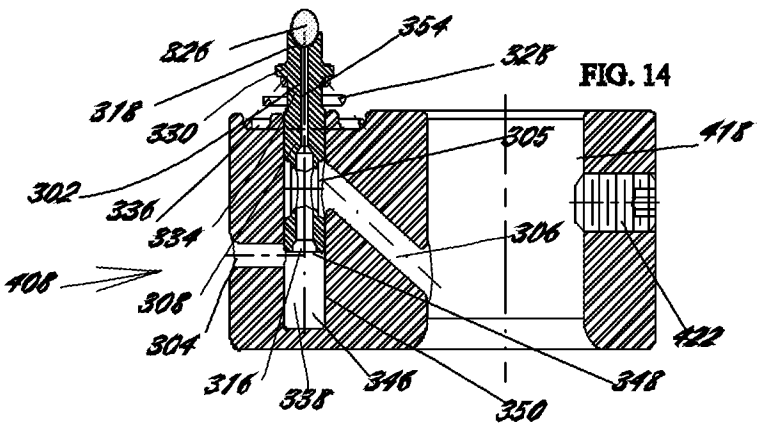
FIG. 14
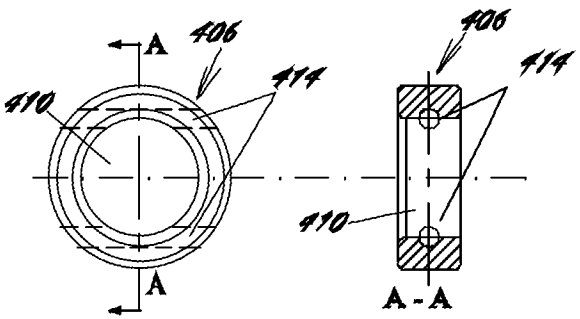
FIG. 13A
FIG. 13

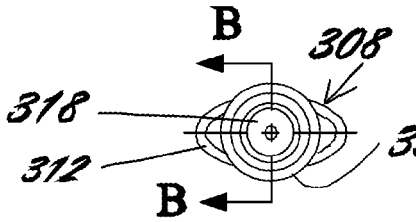
FIG.15
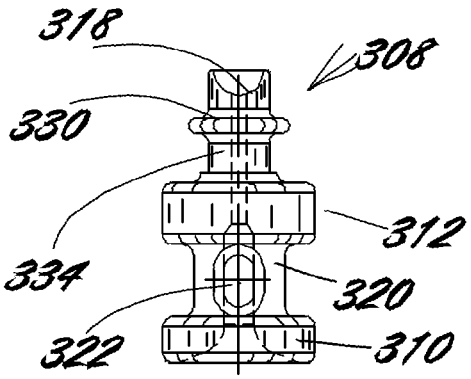
FIG. 15A
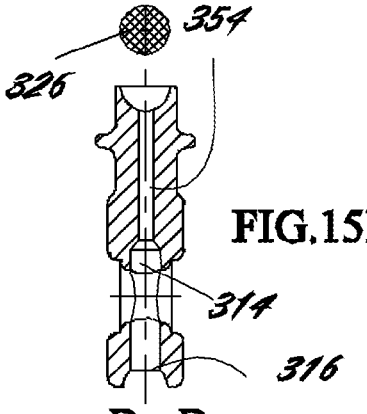
FIG.15B
B - B
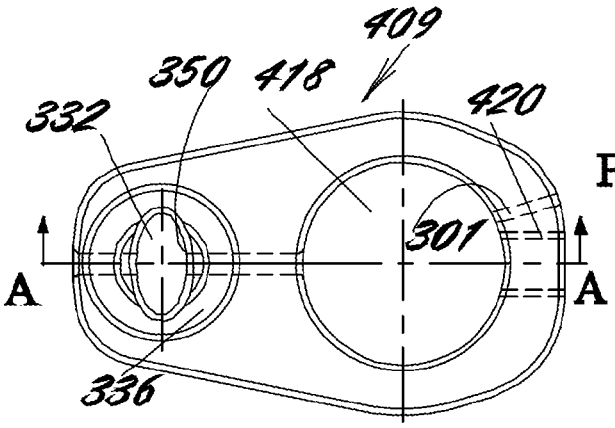
FIG. 16
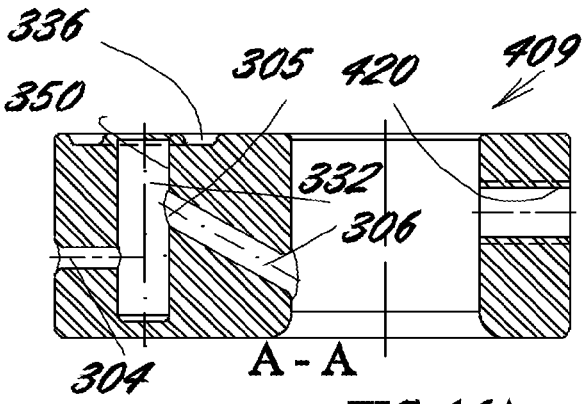
FIG.16A
FIG. 16A
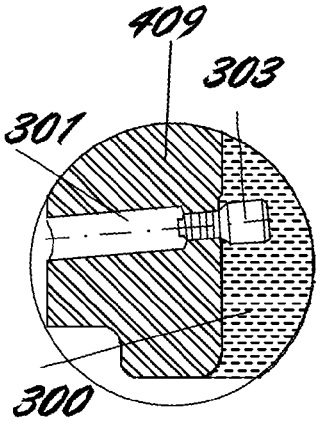
FIG. 17

REVOLVING PISTON ROTARY COMPRESSOR WITH STATIONARY CRANKSHAFT

BACKGROUND OF THE INVENTION

The present invention generally relates to compressors. More particularly, the present invention relates to a rotary compressor having a new structure which increases performance, improves reliability, simplifies assembly procedures, and minimizes the compressor size.

Existing rotary compressors typically comprise a housing, an electric motor with a motor stator secured to the inside wall of the housing by shrink fitting, an internal motor rotor permanently fixed to an unsupported end of a revolving crankshaft to rotatable engaged with the motor stator, said revolving crankshaft extended axially to a mounted below or above the electric motor a pump, which is supported in the housing by welding the pump side or its bearing portion to the wall of the housing at a plurality of points. The pump generally comprises a stationary cylinder block having a bore therein, rigidly fixed to the cylinder block stationary cylinder heads with bearings supporting journalled crankshaft, cylindrical roller precisely mounted around an eccentric section of the revolving crankshaft, sliding vane separating suction space from discharge one and arranged in vane slot located in the wall of the stationary cylinder block between a suction port and a discharge port. A tip end portion of the sliding vane is always put in contact with part of an outer peripheral surface of the rotating roller by force of a back pressure of the discharge gas and a spring.

In the compressor constructed as described above, the motor unit and the compression unit are installed axially with a predetermined distance there between. This distance combined with height of the motor and height of the pump defines as an axial length of the compressor so a transmission loss of the rotating power generating by the motor and distributed to the pump by revolving crankshaft. Any increase of the distance will enlarge the size of the compressor and maximize the transmission loss of the rotating power.

The parts of a prior art rotary compressor are supported as by crankshaft (rotor, roller, etc.), so by the housing (stator, pump, external suction accumulator, etc.). Such dual supporting structure complicates assembly of a compressor due to the necessity of precision axial and radial positioning of the parts. The bore of the stationary cylinder block has to be concentric with the revolving crankshaft and therefore needs to be aligned very precisely as with the crankshaft, so with the revolving crankshaft bearings and the motor rotor. Since in the prior art structures the motor stator and the stationary cylinder block are attached to the housing, the position of the motor rotor has to be aligned with both. It is crucial that the bearings formed in the stationary cylinder heads are aligned with both the motor stator and the stationary cylinder block in order to prevent excessive gaps between an external wall of the roller and periphery of the cavity formed in the stationary cylinder block. Furthermore, distortion can occur in the cylinders vane slot during the welding of the cylinder block to the housing, thereby causing loss of the vane-vane slot clearance and following intensive wear of the contacting surfaces or failure of the compressor.

Attachment of the motor stator has generally been accomplished by shrink fitting and, therefore, the stationary cylinder block and the motor stator have their entire perimeter in contact with the internal perimeter of the housing which has to be machined to have even cylindrical surface. Furthermore, the internal surface of the stator tends to be uneven and eccentric relative to the outer surface thereof due to the laminated construction of the motor stator. When the motor and the pump are assembled together with reference to the internal surface of the housing, the central axis of the motor rotor tends to be inclined against the internal surface of the motor stator. The above described misalignment causes an air gap between the motor stator and the motor rotor to be uneven. When the air gap is uneven, the motor rotor of the motor is urged by magnetic force toward a side of the stator having a narrower air gap, thus increasing load on the crankshaft bearings and maximizing the starting torque of the motor. The housing surface also tends to be deformed from a true cylindrical configuration as a result of welding of end caps, the stationary cylinder block, fittings of discharging and suction pipes, etc., thus changing an established stator-rotor air gap.

The cantilevered position of the motor rotor on the unsupported end of the revolving crankshaft, limitation of the crankshaft diameter by the compressor structure, and large variable gas force affecting the eccentric part of rotating crankshaft, deflect the crankshaft and make the bearings load relatively high. Additional load due to an uneven air gap promotes slanting abrasion of the bearings and increases possibility of a contact between the top edge of the rotor and inner surface of the stator. This phenomenon affects the reliability of the compressor.

The eccentric part of a crankshaft (due to the deflection phenomena) induces a centrifugal inertia force that causes rotational imbalance associated with the problem of noise and vibration of a compressor. The traditional solving method is to add a pair of balancers in the upper and lower side of the motor rotor, considering the revolving crankshaft to be rigid. However, when such traditional method is applied to the inverter controlled compressors (rotation speed more than 3000 rev/min), the level of noise and vibration is not ideal.

Contacting surfaces of the pump parts are subjected to higher wear, and they require as precision machining so extremely close tolerances, which are generally on the order of ten thousands of an inch. Axial and radial clearances between working parts induce internal leakage flow and associated leakage losses which, in combination with frictional losses, have great impact on performance and reliability of the compressor. The leakage and frictional losses in contemporary rotary compressors are due to an operating clearances between the contacting surfaces of the following parts: roller O.D—vane tip, roller O.D.—stationary cylinder I.D., roller I.D.—crankshaft eccentric, roller axial ends-facing stationary cylinder heads surfaces, vane axial ends-facing stationary cylinder heads surfaces, vane sides-stationary cylinder block slot sides, revolving crankshaft-stationary bearings. The contemporary rotary compressors have the rollers' axial and radial surfaces sliding 360° against the surfaces of stationary end wall of the cylinder block and heads. The sliding vane tip forced against the roller end wall by combine load of a spring and a discharge back pressure is main contributor to the friction losses due to practically grinding contact with the roller and continuous sliding of the vane against stationary walls of the cylinder heads and sides of the vane slot significantly increase frictional losses. An additional leakage of the flow is through the clearances, which are necessary for the vane reciprocating movement. Precision machining is necessary for the prior art compressor parts to reduce frictional and internal leakage losses.

The contact between roller O.D. and vane tip (and associated frictional losses) has been eliminated in the conventional swing type rotary compressors due to the design of roller and vane as one part. However, frictional and leakage losses are high due to an increase areas of roller-integral vane radial ends surfaces facing stationary cylinder heads.

Furthermore, in the prior art compressors, the suction gas is generally supplied from a suction accumulator, which is externally attached to the compressor housing. Primarily, the accumulator receives and accumulates the vapor-liquid mixture from evaporator of the unit and serves as a reservoir and separator of the liquid, gas and oil. The output tube of the accumulator passed through a hole in the housing and requires an inline hole which has to be precision positioning in the wall of the cylinder block. This tube is in direct communication with the suction chamber. However, with direct delivery of a vapor-liquid mixture to a suction chamber, there can be a problem with slugging. Slugging is a condition that occurs when a mass of liquid, here from accumulator, enters the suction chamber. This liquid, when in sufficient volume and being essentially incompressible, adversely affects the operation of the compressor and can cause severe damage.

Still another problem associated with prior art hermetic compressor arrangements is that the resistance to incoming suction gas from the accumulator is high, generally a resistance co-efficient of at least 0.5. The suction port acts as a throttle and the pressure drop across the accumulator (a critical system efficiency parameter) is high due to the resistance to the suction gas flow.

Since the accumulator is mounted in a close proximity to the compressor housing, any heat and vibration generated by the compressor and the unit will be transmitted directly to the accumulator. The combined load of the pressure pulsations and vibrations triggered by operation of the compressor and associated unit will stress the joints between the housing and the accumulator output tube, the accumulator inlet and the evaporator output conduit and is sometimes sufficient to fatigue and damage the individual components. Due to the fact that an accumulator has large radiation surface area, its contribution to a compressor noise is substantial. An accumulator noise generation mechanism includes structural vibrations transferred through connecting tubing as from the compressor side, so from the unit side and an accumulator cavity acoustic resonances excited by suction pressure.

The proximity of the accumulator to the hot housing and its external positioning helps transfer heat to the suction gas as from the compressor, so from surrounding environment. The overheating of the gas being drawn causes an increase in the specific volume and, consequently, a reduction of the refrigerant mass flow. Since the refrigerating capacity of the compressor is directly proportional to the mass flow, reducing said flow results in efficiency loss. Furthermore, moisture condensation on a surface of the accumulator and connecting tubing triggers corrosion, which can damage the suction system. In addition, the complexity and dimensions of the accumulator (very often ⅔ of the compressor size) drastically increases the compressor cost and maximize a necessary package space.

In operation of a rotary compressor, as roller revolves inside the stationary cylinder bore when the crankshaft rotates, refrigerant enters the bore through suction port. As the volume enclosed by vane, roller and the wall of bore is reduced in size by the rolling action of the roller, refrigerant will be compressed and will be discharged from the cylinder bore through discharge valve into an inner space of the housing, than flows through rotor-stator air gap and discharge tube toward a unit. An elevated temperature of the discharge gas-oil mixture and high pressure pulsation may provide inadequate cooling of the motor. Such an electric motor operating conditions during long operating cycles will cause overheating of the motor stator winding and can lead to premature motor failure.

SUMMARY OF THE INVENTION

The present invention overcomes the disadvantages of the above described prior art compressors by providing an unitary compressor assembly, in which an external rotor electric motor and a pump parts have been radially integrated to form a compressor pump arranged coaxially on a non-rotating or stationary crankshaft with opposite ends of latest thereof fixedly mounted to the compressor housing. External rotor electric motor, which consists of a rotor revolving outside of the stator, has much higher torque, wider speed range, higher operating efficiency even at low rotational speed, outstanding power density, low starting current, excellent dynamic characteristics, more compact design, reduced noise, vibration and lower fabrication and assembly cost than internal rotor electric motors (see, for example, external rotor electrical motors catalogue MO1, ZIEL-ABEGG Co., Germany).

The construction of the compressor pump comprises, in combination: a revolving piston assembly having a piston cylinder with a coaxial cavity therein, said piston cylinder being rotatably mounted on the opposed ends of the stationary crankshaft via piston heads equipped with the bearings in the central projections and flanges detachable fixed circumferentially to the opposed ends of the piston cylinder; a driver—an external rotor motor, with a motor stator rigidly secured (press-fit, shrink-fit) to the stationary crankshaft eccentric and an external rotor cylinder surrounding the stator comprising a rotor cylinder, inner wall of which housing a plurality of permanent magnets even spaced by an air gap from the facing surface of the stator to form a brushless external rotor motor, said rotor cylinder being rotatable mounted on the eccentric of the stationary crankshaft via a lower and an upper rotor heads each having a central projection equipped with a bearing and a flange portion being circumferentially detachable fixed to the opposed ends of the rotor cylinder, whereby forming a rotor block which housing a motor compartment. The rotor block is smaller than the piston cylinder cavity and mounted via bearings in central projection therein rotatably on the same crankshafts eccentric that support the stator.

Stationary crankshaft is fixedly connected to the hermetic housing and supports as the fixed to it motor stator, so spinning around it the rotor block and the revolving piston assembly. The single structure supporting the motor stator, the rotor block, the revolving piston assembly and housing will simplify compressor assembly, and allows precision, reliable and easy setting of the motor air gap, concentricity and eccentricity due to the reliable and common single datum reference—axial line of revolution. The housing has no mounting contacts (such as shrink fit of a stator in the housing, welding of the housing to the cylinder bock, etc. present in prior art rotary compressor). So, welding operations will not distort the settings established during assembly.

An extremely compact, therefore space saving, compressor unit have been developed by integrating radially an external rotor motor with the rotary compressor components. Such modification helps to minimize an axial length of the pump, simplify balancing of the unit, reduces rotating power transmission losses and bearings loads, eliminates precision machined roller and vane spring, used, as usual, in prior art compressors. All advantages of the external motor rotor described above will enhance performance of the proposed novel rotary compressor.

The rotor block and revolving piston assembly, are rotationally supported on opposed ends of the stationary crankshaft by the bearings disposed positioned symmetrically below and above the stator. Such mounting arrangement eliminates usually observed in prior art compressors concentration of forces on the bearing end of the crankshaft due to the cantilever positioning of an electric motor rotor on a remote non-supported end of the crankshaft. The symmetrical distribution of forces applied to the bearings spaced below and above the stator reduces the deflection of the crankshaft triggered by variable gas forces, minimize the bearings wear due to symmetrical distribution of the load and, consequently, improves the reliability of the compressor.

The piston cylinder is disposed eccentrically outside of the rotor cylinder with the direct (no operating clearance) contact between the cylindrical surface of the piston cylinders coaxial cavity and external peripheral surface of the rotor cylinder. The direct line contact of the rotor cylinder and eccentrically fit around piston cylinder lies in the plane passing through the lines of centers of rotation which are fixed. In such kinematic coupling a motion of the rotor block (driver) is transmitted to the spaced outside revolving piston assembly (follower), and both of them rotate in the same direction due to a force developed at the contact line. The line of contact became the instant center where the tangential (linear) velocities of the rotor block and the revolving piston assembly are unidirectional and equal in magnitude. The angular velocities for such kinematic coupling, expresses usually in rev/min and will be inversely proportional to the radii: $N/n=r/R$, where r and n are, consequently, radius and rotational speed of the rotor block (driver); R and N—radius and rotational speed of the revolving piston assembly (follower). So, if $n=3000$ rev/min, $r=3$ in., and $R=3.0625$ in (eccentricity is equal 0.0625 in.), the angular velocity of the revolving piston assembly will be≈2939 rev/min and the relative speed for this two bodies revolving in the same direction will be only≈71 rev/min.

The vane of the novel rotary compressor is formed integrally with the piston cylinder or can have one edge rigidly fixed in an axial groove formed in the inner periphery of the piston cylinder with an opposite axial edge slidably fitted in between the bushings mounted in the rotor block. The vane radial edges are detachable rigidly fixed without clearance in between the piston heads. The vane does not slide or swing. The vane, however, not only serves to separate a working space between rotor block and revolving piston assembly into suction chamber and compression chamber, but it also forms a mechanical connection (coupler) so that the motor revolves simultaneously the rotor block and the revolving piston assembly and any possibility of a slippage at the line of contact is eliminated.

The rotor block and integral piston cylinder—vane rotate simultaneously in the same direction. The rotor block and eccentrically fit revolving piston assembly have only one line rolling contact, where linear (tangential) velocities of both are equal in magnitude and are unidirectional. It means that the sliding frictional losses at the rolling contact between the revolving piston assembly and the end wall of the rotor block will be eliminated. The frictional losses between the radial end surfaces of the rotor block and facing surfaces of the piston heads will be minimal due to the low relative rubbing speed (see data above) between synchronously revolving in one direction contacting surfaces. Exclusion of a roller as a piston in the novel rotary compressor, employment of a vane rigidly fixed in the revolving piston assembly eliminates related leakage and frictional losses and necessity of the precision machining. Absence of the axial operating clearance between the revolving piston assembly and the rotor block will completely eliminate related leakage losses, sliding frictional losses, excludes associated precision machining and necessity to distribute lubricant to the mating surfaces which is required for proper operation of prior art sliding vane or swing rotary compressors.

The suction system of the novel rotary compressor comprises, in combination, a suction input cavity which is disposed inside of the compressor housing and is an integral part of it, the motor compartment equipped with an impeller which has been rigidly fixed to the rotor head below or above the stator, a suction port at the top of the motor compartment wall and a variable volume suction chamber. The motor compartment is in fluid communication as with the suction input cavity through a channel inside of the stationary crankshaft, so with the suction chamber through plurality of vertical channels formed in the wall of rotor block and the suction port. A suction inlet directs a vapor-liquid mixture of refrigerant and lubricating oil through a screen (to filter the impurities) into the inner volume of the suction input cavity, where gas flows to the top and the liquid due to the gravity collects above the upper end cap, separating high and low side of the housing. An input opening of the crankshafts suction channel has been located close to the top of the suction input cavity and above level of the suction inlet to prevent liquid from entering directly into the crankshaft suction channel. The heat generated by high side discharge gas will be transferred trough the housing upper end cap to the liquid collected at the bottom of the suction input cavity and will significantly accelerate a vaporization process. A small hole at the low point of the crankshafts part located in the suction input cavity helps to return compressor oil to a circulation. The vapor drawn from the suction input cavity will be delivered to the part of the motor compartment spaced below the stator where centrifugal force which triggered by rotation of the rotor block will forcibly guide oil to the formed in the side wall of the rotor block a mitering (bleeding) hole which is in fluid communication with the suction chamber. The vapor portion of the refrigerant, pressure of which has been increased by an impeller, will be supercharged in the suction chamber through the suction port which positioned remote from the suction input cavity to prevent direct supply of the fluid.

Design of the novel rotary compressor eliminate suction accumulator which, as usual, assembled externally on the side of the housing in prior art rotary compressors. The internally spaced suction system of the novel rotary compressor prevents direct delivery of the vapor-liquid mixture of the refrigerant with oil to the suction chamber by interposing a suction input cavity, which is an integral part of the housing, and a motor compartment between the suction system intake located at the top of the housing and remotely spaced suction port inlet positioned at the top of the motor compartment. The lubricant and the liquid portion of the refrigerant will be partially separated in the suction input cavity and further forcibly separated oil and liquid refrigerant from vapor by action of centrifugal forces developed due to rotation of the rotor block which housing the motor compartment. The vapor will be delivered substantially free of liquid refrigerant into the suction chamber under higher pressure (supercharged) due to the action of the impeller.

This dual process of vapor-liquid separation drastically reduces the likelihood of slugging and increases capacity of the compressor. Supercharging also raises the effective compression ratio of the compressor and improves its performance.

Another advantage of the presented suction system is that such arrangement of a refrigerant delivery to the suction chamber also increases the liquid refrigerant storage capacity and provides efficient cooling of the electric motor by vapor and liquid passing through the motor compartment.

A further advantage of the novel rotary compressor is that elimination of an external accumulator excludes a negative effect of relatively high ambient temperature and following accumulation of moisture on external walls of the accumulator and connecting tubing. It also opens access to housing surface areas for painting, thereby avoiding potential oxidation and rust.

Yet another advantage of the novel rotary compressor equipped with the suction system described above is that after elimination of the external accumulator the compressor is compact (smaller package space), has better configuration, lower assembly and manufacturing cost, and is more reliable.

The compressor pump components are adapted to rotate around the stationary crankshaft within a fixed to it opposed ends hermetically sealed compressor housing. When the compressor pump rotates, a refrigerant gas, which has been delivered from the suction port, is compressed and expels through at least one discharge port formed in a rim of the piston cylinder. Each discharge port may generally comprise a discharge valve equipped with a flat valve reed fixed at one end between a valve stop and mounting surface, mounting screws, etc. A disadvantage of such valve system, generally used in prior art rotary compressor, is high level of residual stress concentrated close to the fixed end of the valve due to the cantilever clamping of the reed. Still another disadvantage of such valve is a re-expansion of a discharge gas left in the discharge port cavity after closing of the valve. This volume of gas never leaves the working space but is repetitively compressed and re-expanded during operating cycle. Re-expansion volume causes a loss of energy efficiency in a compressor.

The present invention overcomes the aforementioned problems by providing a discharge valve system with an increased vapor flow, minimal gas re-expansion volume and reduced residual stress. The discharge assembly comprises a cylindrically shaped valve member cut from thin-walled spring steel tubing wall of which has been clamped sidewise to the wall of an elliptically shaped discharge chamber formed at the end face (rim) of the piston cylinder. Micro-Group Co. (USA, info@microgroup.com) produces small diameter/thin walled (0.006" thick and up) seamless or welded tubing in wide varieties of metals that can be used for fabrication of the tubular type valve.

An advantage of the discharge valve system of the present invention is that the tubular thin walled valve member has its entire port seating surface immediately exposed to fluid pressure generated within the compression chamber on opening. The curved shape of the exposed valve member surface has larger area than any exposed flat discharge surface of the same port diameter prior art reed valve. The maximum exposure of the tubular valve member during opening to compressed fluid accelerates valve opening thereby increasing the performance of the compressor while decreasing possible throttling effects.

Another advantage of the discharge valve system of the present invention is that use of cylindrically shaped valve retainer, spaced within the tubular valve, to clamp it sidewise to the wall of the elliptical chamber provides that no special valve alignment is necessary at compressor assembly time. The tubular valve member O.D is larger than a minor diameter of elliptical valve cavity. During assembly, after the tubular valve is slid inside of the elliptical discharge chamber and the valve retainer is in place, the tubular valve clamped by the retainer to the wall of the elliptical discharge chamber will be automatically align with the valve port.

Still, another advantage of the discharge valve system of the present invention is that the valve member is supported in process of opening on both sides of the clamping line by adjacent back wall of the elliptical discharge valve cavity and valve back support area will increase as the load triggered by the discharge pressure rises. For a cylinder of small wall thickness, which represents valve member, the circumferential stresses triggered by the discharge pressure are distributed, generally, almost uniformly across the thickness, and radial stresses bears the same relation to the circumferential stresses as the thickness bears to the radius. The tubular valve member may be regarded as thin-walled bar, a wall of which is rigidly clamped axially so that clamped line divides a distributed stress on two symmetrical parts.

A further advantage of the discharge valve system of the present invention is that the shape of the valve seat along with the radiusing of the valve port edges minimizes the pressure drop across the opening allowing smooth flow of gas since there is an absence of sharp turns. This structure improves the efficiency of the compressor and prevents valve flutter thereby eliminating intermittent chattering noises. During discharge stage of the cycle a back side of the discharge valve member part facing said discharge port has only a line contact with the cylindrically shaped valve retainer and a completely open concave surface of said back side is affected by high pressure of the discharge gas which in combination with the spring force of said compressed valve member will accelerate the discharge port closure.

Another advantage of the discharge valve system of the present invention in the preferred form of the invention is that the valve port and valve member have the same particular radius of curvature on their cylindrical segments. This structure ensures that any shifting, cocking or tilting of the valve member at closing will not affect the valve sealing and seating ability.

The energy developed by the discharge process of contemporary rotary compressor is a waste. The velocity of the gas ejected from the discharge port is, as usual, in the limits of 70 to 135 ft/sec. The discharge gas mixed with oil flows into an inner space of the housing and distributed through a rotor-stator air gap and output discharge tube to a unit. An elevated temperature of the discharge gas-oil mixture and high pressure pulsation may provide inadequate cooling of the motor. Such an electric motor operating conditions during long operating cycles will cause overheating of the motor stator winding and can lead to premature motor failure.

A further advantage of the discharge assembly of novel rotary compressor is that the discharge fluid distributed to a discharge expansion cavity equipped with a plurality of circumferentially formed reaction nozzles which are disposed remote from the stationary crankshaft. The nozzles are projected outwardly from inner volume of the discharge expansion cavity to the periphery of the piston cylinder which is rotatable mounted on the stationary crankshaft. The nozzles have fluid discharge passageways therein inclined rearwards relatively to the intended direction of rotation of the revolving piston assembly in reaction-rotation-producing relationship thereto so, when discharge fluid ejected from outlets of the discharge passageways of the nozzles outwards, the jets of high pressure fluid impart to the revolving piston assembly a driving moment that causes assembly rotation relative to the stationary crankshaft. This driving moment will combine with the momentum transferred from the rotor block to the revolving piston through the vane and a supplemental angular momentum due to absence of an operating clearance at a contact line of inner periphery of the piston cylinder cavity and external surface of the rotor cylinder. An approximate value of the reaction force R exerted on the revolving piston by a discharge gas ejected from the single nozzle can be calculated by using the following general equation:

$$R=\rho_d A_n V_d^2+A_n(P_d-P_h),$$

where $\rho_d$, $V_d$, and $P_d$ are, correspondingly, density, velocity of flow and pressure of the discharge gas ejected from the nozzle which has cross-sectional area $A_n$, $P_h$—pressure of the media surrounding the revolving piston inside of the housing. At this juncture, it should be noted that reaction force causing rotation of the revolving piston assembly is a function of pressure of gas supplied to the expansion chamber, the size and capacity of the nozzle coupled to the expansion chamber, the larger the supply pressure and/or larger the nozzle size, then greater the reaction force created, and, hence then higher the rotational speed of revolving piston assembly. The supplementary angular momentums will, definitely, reduce a load of the electric motor.

In conventional rotary compressors an external electrical circuit basically includes an electrical terminal carrying the circuit though the housing, start and run capacitors, a solid state relay, a thermally operated overload protector, etc. An electrical terminal box secured, as usual, externally to the top cap or to the outer circumference of the compressors high side housing is used to accommodate some or all of the items specified above. Furthermore, another inverter storage box is provided on an outer circumference of the housing for inverter controlled compressors. In addition, the power supply and control wires located inside of a prior art compressors housing are in proximity to the mowing parts and are subjected to intensive discharge pressure pulsations and an elevated temperature of a discharge gas-oil mixture passing at high velocity (70 to 135 ft/sec) through the motor stator-rotor gap to an discharge outlet.

The design of the novel rotary compressor made it possible to locate specified above items of the external electrical circuit in the storage space positioned in the limits of the compressor housing and adjusted to the cool wall of the suction cavity. The hollow part of the crankshaft, denoted as the suction channel, is used also as a conduit for internally running power supply wires and wires controlling operation of the electric motor, so for delivery of suction gas. An advantage of such modifications is that, after elimination of plurality of external electrical boxes, the compressor is compact (smaller package space), has better configuration, lower manufacturing cost and is more reliable. In addition, the power supply circuit elements are protected from effect of high ambient temperatures, moisture, are safer, and elimination of bulky boxes and external accumulator open access to the housing surface areas for painting, thereby avoiding potential oxidation and rust. Furthermore, the close proximity of the cylindrical storage space to the cool wall of the suction cavity makes it convenient for compressors utilizing inverters to arrange cooling of power semiconductor modules.

BRIEF DESCRIPTION OF THE DRAWINGS

The above-mentioned and other features and objects of this invention, and the manner of attaining them, will become more apparent when the invention itself will be better understood by reference to the following description of an embodiment of the invention taken in conjunction with the accompanying drawings, wherein:

FIG. 3D is a sectional view of the rotor block of FIG. 3A along line D-D;

FIG. 12 is view of the stationary crankshaft of the rotary compressor of FIG. 4 with series of cross-sectional views along it;

FIG. 13 is a top view of the thrust bearing block for the mounting assembly of the compressor pump of FIG. 1;

FIG. 13A is a sectional view of the thrust bearing block of FIG. 13 along line A-A;

FIG. 14 is a sectional view of an integral oil pump-thrust seat block of the present invention;

FIG. 15 is a top view of the oil pump piston;

FIG. 15A is an elevational view of the of the oil pump piston of FIG. 15;

FIG. 15B is a sectional view of the oil pump piston of FIG. 15 along line B-B;

FIG. 16 is a top view of the integral oil pump holder;

FIG. 16A is a sectional view of the integral oil pump holder of FIG. 16 along line A-A;

FIG. 17 is fragmental sectional view of a unidirectional valve assembly positioned in the oil pump holder of FIG. 16.

Figure 1:
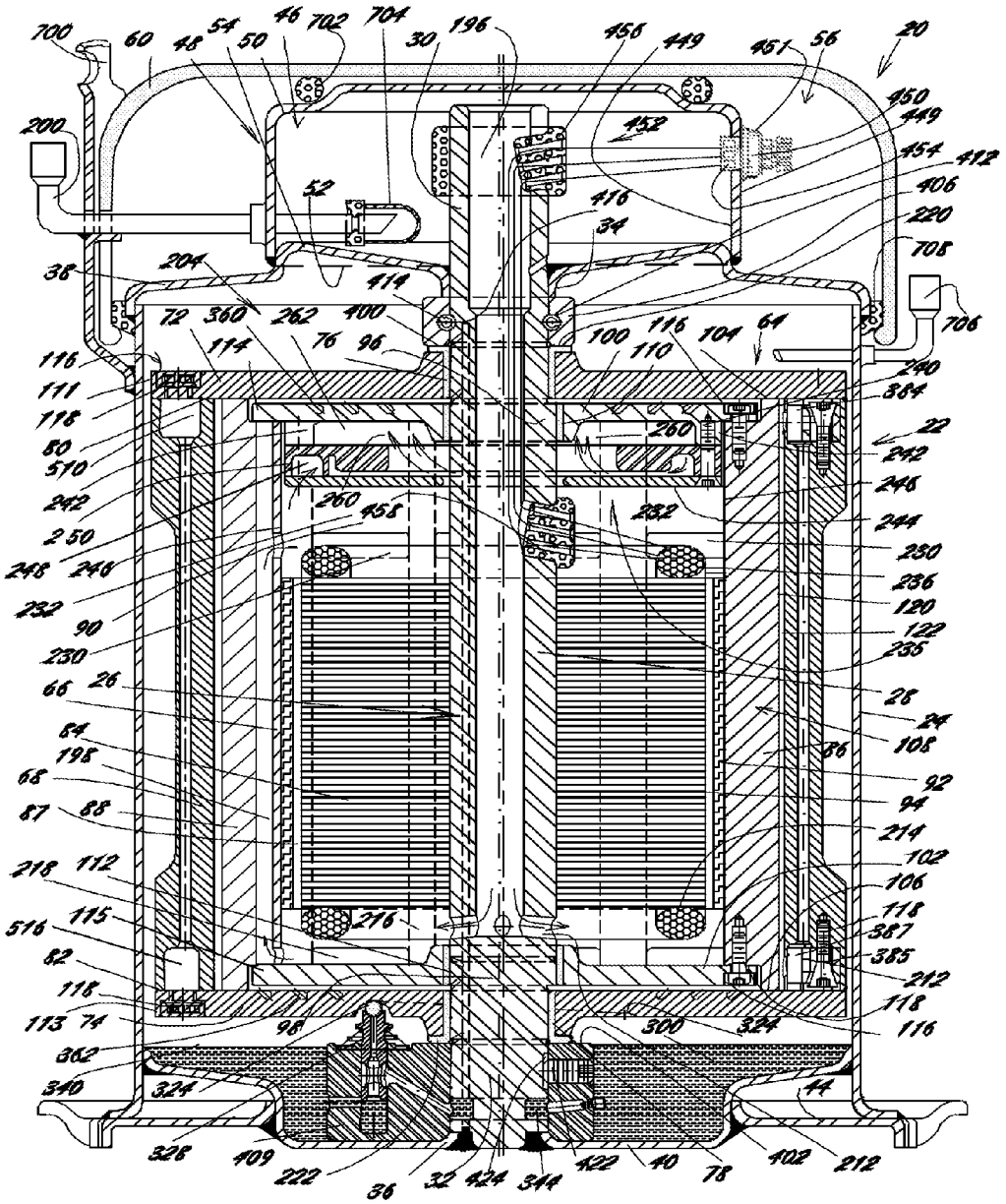
FIG. 1 is a side sectional view of a novel rotary compressor (impeller at the top) in accordance with the present invention.

Corresponding reference characters indicate corresponding parts throughout the several views. Although the drawings represent an embodiment of the present invention, the drawings are not necessarily to scale and certain features may be exaggerated in order to better illustrate and explain the present invention.

DETAILED DESCRIPTION OF THE INVENTION

Referring to the drawings and more particularly to FIG. 1, there is shown a vertically oriented novel rotary compressor 20 comprising generally housing 22 defined by cylindrical main body portion 24 coaxial with stationary crankshaft 26 having an integrally formed eccentric 28, smaller diameter ends 30 and 32 extended axially through, correspondingly, circular central apertures 34 and 36 fabricated in upper cap 38 and lower cap 40 which are interposed in cylindrical main body portion 24 between upper cap 38 and base mounting bracket 44. Upper cap 38 and lower cap 40 are defined the hermetically sealed high side part 204 of housing 22 by welding, brazing, or the like circumferentially to the perimeter of the housing main body 24 and centrally to the walls of the ends 30, 32 of the stationary crankshaft 26 passing through the openings 34 and 36. The hermetically sealed suction input cavity 48 is an integral part of the housing 22 and has been formed by securing (welding, brazing, etc.) of suction cup 50 open end 52 to the cylindrical projection 54 of the upper cap 38. The base mounting bracket 44 is secured to the housing 22 by any suitable method including projection welding.

Figure 2:
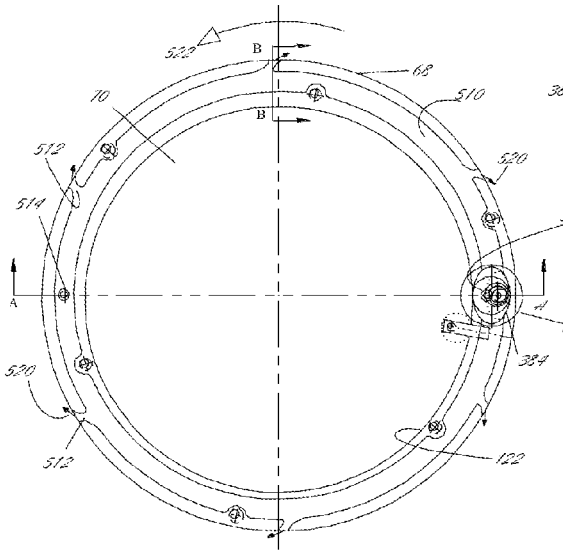
FIG. 2 is a top view of the piston cylinder.
Figure 2A:
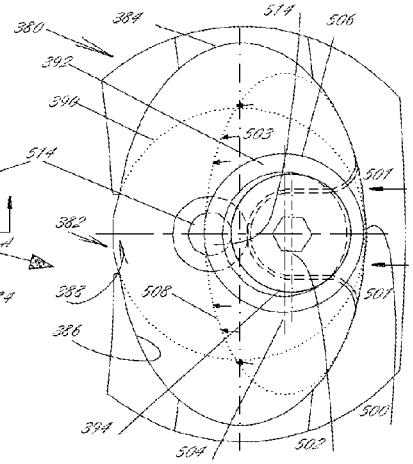
FIG. 2A is an enlarged fragmentary top view of the discharge valve assembly of FIG. 2.

Located in the main body portion 24 of the housing 22 is a compressor pump 64 formed by radial integration of an electric external-rotor motor 66 with a pump parts and arranged coaxially on the stationary crankshaft 26. The compressor pump construction comprises, in combination: a revolving piston assembly 68 having a piston cylinder 70 with cavity therein (see FIGS. 1, 2 and 2B) and rotatably mounted on the opposed ends 30, 32 of the stationary crankshaft 26 via piston heads 72, 74 equipped with bearings 76, 78 in a central projection aperture and flanges detachable fixed circumferentially to the opposed ends 80, 82 of the piston cylinder 70; a drive motor 66 with a motor stator 84 interference or shrink fit fixed on eccentric 28 of the stationary crankshafts 26; an external rotor 86 of the motor (see FIGS. 1, 3 and 3A) which consists of a rotor cylinder 88, inner wall of which, surrounding motor compartment 90, housing plurality of permanent magnets 92 even spaced by an air gap from the facing surface 94 of the motor stator 84 to form a brushless external rotor motor 66. The rotor cylinder 88 is rotatable mounted on the ends 96, 98 of the crankshafts 26 eccentric 28 via a rotor heads 100,102, flanges of which are circumferentially detachable fixed in the recess of the opposed ends 104, 106 of the rotor cylinder 88. The external motor rotor—heads assembly, denotes as the rotor block 108 below, is smaller than the piston cylinder 70 cavity and mounted therein coaxially with the stator 84 and operable to rotate around the outside of the stator 84 via the rotor heads bearings 110 and 112 inserted in the central projection aperture.

One type of suitable material for bearings 76, 78, 110 and 112 includes a polyamide such as VESPEL SP-21, which is a rigid resin material available from E.I. Dupont de Nemours and Co. The polyamide material has a broad temperature range of thermal stability, capable of withstanding approximately 300,000 lb. f/in. with a maximum contact temperature of approximately 740° F. (393° C.) without lubrication. The bearings are press-fit into the heads central projection apertures and thrust surfaces 220, 222 of the bearings 76 and 78 (see FIG. 1) are provided with radially extending groves (not shown). Grooves are provided in thrust surfaces 220 and 222 for communicating lubricating oil between the bearings and the interfacing supporting surfaces 400,402 of, correspondingly, a thrust bearing block 406 and an integral oil pump—thrust seat assembly 408 which are assembled at opposite ends of the crankshaft 26 to limit an axial movement of the compressor pump 64. The supporting surfaces 400,402 are in abutting contact with corresponding facing surfaces of the thrust bearing block and the thrust seat of the integral oil pump.

A disk shaped thrust bearing block 406 (see FIGS. 12, 13 and 13A) is provided with central aperture 410 through which the upper end 30 of the crankshaft extends. In process of assembly the thrust block 406 is secured above the pump 64 to the end 30 of the stationary crankshaft 26 by means of split tubular spring pins 412 which are firmly driven in holes 414 aligned with the crankshafts semicircular keys 416 to prevent relative axial and rotary motion between the mating parts.

The integral oil pump-thrust seat assembly 408 is provided with aperture 418 to accommodate lower end 32 of the crankshaft 26 and has a radial threaded hole 420 to receive a set screw 422 with a flat point (see FIGS. 4, 12, 14, 16 and 16A). The flat 424 milled at the end 32 of the crankshaft 26 assists in positioning of the pump 64 axially and reliable fix it at predetermine position on the crankshaft 26 with limited or no axial play.

Figure 2B:
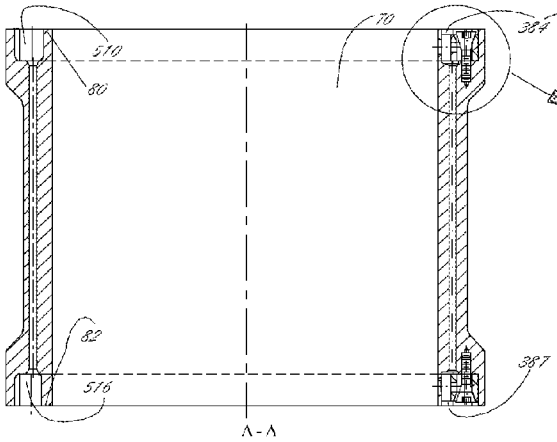
FIG. 2B is a sectional view of the piston cylinder of FIG. 2 along line A-A.
Figure 3:
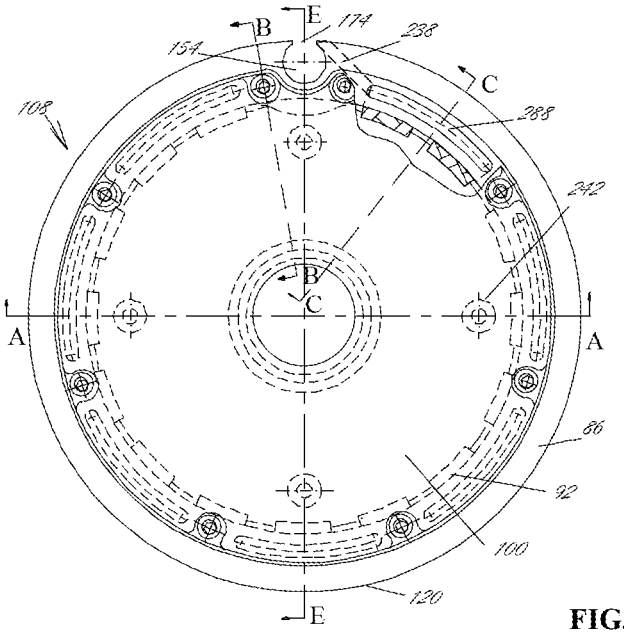
FIG. 3 is a top view of the rotor block.
Figure 3A:
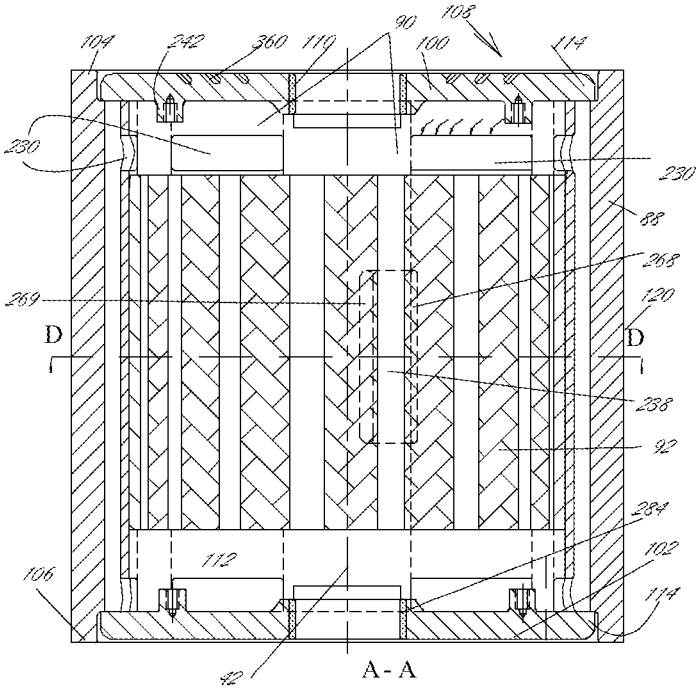
FIG. 3A is a sectional view of the rotor block of FIG. 3 along line A-A.
Figure 3B:
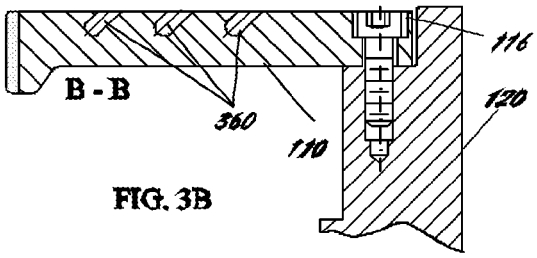
FIG. 3B is a sectional view of the rotor block of FIG. 3 along line B-B.
Figure 3C:
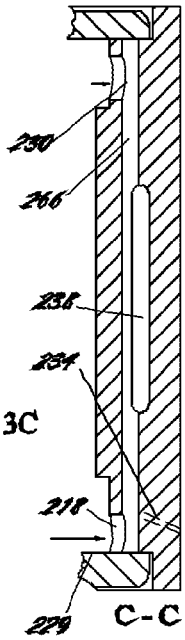
FIG. 3C is a sectional view of the rotor block of FIG. 3 along line C-C with bottom mounted impeller.
Figure 4:
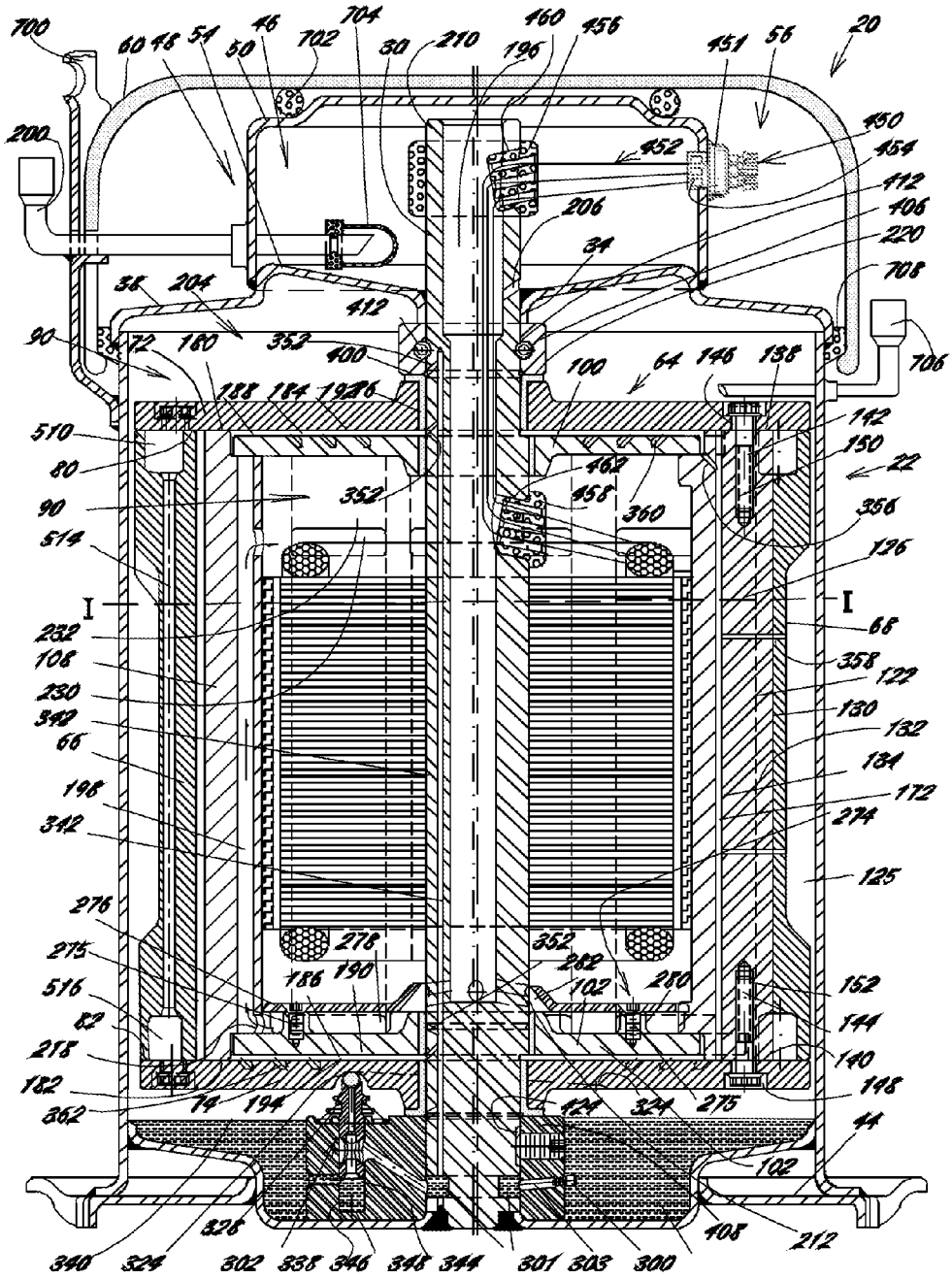
FIG. 4 is an additional side sectional view of the rotary compressor (impeller at the bottom) in accordance with the present invention.

End surfaces 80, 82 of the piston cylinder 70 and end surfaces 104, 106 of the rotor cylinder 88 are in abutting sealing contact with, correspondingly, opposite end surfaces of the piston heads 72, 74 and rotor heads 100, 102 (see FIGS. 1, 2B, and 4). Annular flanges 111, 113 of the piston heads 72, 74 and annual flanges 114, 115 of the rotor heads 100, 102 are provided with oversized apertures 116, and end surfaces 80, 82 of the piston cylinder 70 and 104, 106 of the rotor cylinder 88 are provided with threaded apertures (not shown). Fasteners 118 extend through the aligned apertures, threadedly fixing heads, correspondingly, on the end planes of the piston cylinder and the rotor cylinder. To address the potential assembly issue related to the rotor-stator air gap, described above for prior art compressor, and prevent premature failure in the inventive compressor, oversized apertures 116 are allowing the rotor cylinder 88 to be precisely located radially during compressor assembly so that the rotor-stator air gap 87 is even, and move, correspondingly, piston cylinder 70 in predetermined position to make tight line contact between the inner wall of the piston cylinder and the peripheral surface of the relocated rotor cylinder.

The rotor block 108 is disposed inside of the piston cylinder 70 cavity with the direct (no operating clearance) line contact 121 between the outer peripheral cylindrical surface 120 of the rotor block 108 and inner cylindrical surface 122 of eccentrically positioned revolving piston assembly 68. In direct contact mechanisms such coupling of two cylindrical bodies having internal rolling contact very often is used to transfer motion from one rigid body to another. In order to have rolling contact without slippage between the surfaces at a point common to two bodies they must fulfill the following condition: the line of centers must pass through the point of contact, and the arcs of contact must be of the equal length. In our case we have all points of contact line 121 located in the plane passing through the stationary axes of the revolving piston assembly 68 and rotor block 108. It is important to note that though it is necessary for the point of contact to lie on the line of centers if there is to be rolling, this is not sufficient. Motion will be successfully transmitted from one body to the other without slippage only if there is sufficient coupling friction at the contact surfaces which is achieved in present invention by tight fit between inner cylindrical surface 122 of the revolving piston assembly 68 and external cylindrical surface I 120 of the rotor block 108 during assembly of the compressor pump 64. As it described above, the annular flanges 111, 113 of the piston heads 72, 74 and the annular flanges 114,115 of the rotor heads 100,102 are provided with oversized apertures 116, which permit radial movement of the piston cylinder 70 to put it in tight axial contact with the rotor cylinder 88.

A crescent shaped space formed in between the rotor block and eccentrically fit revolving piston assembly defines a working cavity 176 of the pump 64 (see FIGS. 5 and 6 through 9). The vane 126 of the compressor pump, which can be formed integrally with the piston cylinder 70 or rigidly fixed to the side of inner wall 122, divides working cavity 176 into suction chamber 124 and compression chamber 128 and has an axial edge 130 immovable fixed in an groove 132 formed in the inner periphery 122 of the piston cylinder 70 with an opposite vane edge 134 slidably fitted in between the guide bushing 136 semi-cylindrical parts 156, 158 mounted in an aperture of the rotor cylinder 88. The vane radial edges 138, 140 are positioned without clearance between the inner surfaces of the piston heads 72, 74 and rigidly fixed to the piston heads by fasteners 142, 144 extended through, correspondingly, oversized apertures 146, 148, and threaded into apertures 150, 152 (see FIG. 4). The vane 126, however, not only serves to separate the working cavity 176 between rotor block and revolving piston assembly into suction chamber 124 and compression chamber 128, but it forms also a mechanical connection (coupler) so that the external rotor motor 66 revolves simultaneously in the same direction the rotor block 108 and the revolving piston assembly 68. It also prevents slippage between cylindrical surfaces at the line 121 of their contact.

Referring to FIGS. 3 and 3A through 3E, in order to allow for the relative sliding between vane 126 which extends radially inwardly from the piston cylinder 70 into rotor block 108, said rotor block is provided with the cylindrical aperture 154 axis of which is parallel to the vertical axis 42 of the rotor block rotation. The cylindrical aperture 154 extends longitudinally through the wall of rotor cylinder 88 and defines an opening 174 in an outer peripheral surface 120. A guide bushing 136 has semi-cylindrical parts 156, 158 which are mounted in aperture 154 so that a slot 172 (see FIG. 5) is formed in between their flat surfaces 160, 162 which are slidably engage upon opposed planar surfaces 164, 166 of the vane 126. The compressor pump 64 parts are designed to rotate in a counter-clockwise direction 522. From observation of FIGS. 6, 7, 8, and 9 it will be noticed that, when the rotor block is rotated, the revolving piston assembly will be driven simultaneously by the interaction of the vane 126 upon the bushings 136 leading part 156 which drive the revolving piston assembly by virtue of its bearing in the seat 168 of the cylindrical aperture 154, said leading part 156 positioned on the suction side 170 of the vane. The bushings 136 will oscillate within aperture 154 to allow for change in angular position of vane 126 as rotor block 108 and revolving piston assembly 68 are rotate. In the illustrated embodiment, bushing has two separate parts—156 and 158, however, alternative embodiments may employ a single piece bushing wherein an interconnecting web of material extends between the two halves of the bushing through a portion of slot 172 and is sufficiently thin to avoid interfering with the inner axial end of vane 126 during rotation of rotor block and revolving piston assembly.

Guide bushing 136 can be made from a material with suitable antifriction properties. In the illustrated embodiment guide bushings 136 is formed from Vespel SP-21, a material which facilitates the reduction of frictional losses. The use of guide bushings 136 made from a material with good antifriction properties promotes reduction of friction and wear of guide bushings surfaces facing walls of rotor block aperture 154 and vane planar surfaces 164, 166 that are in moving contact to thereby improve the longevity and reliability of the compressor.

As discussed above, and in more detail below, vane 126 is rigidly fixed axially (without operating clearance) within groove 132 or, perhaps, integrally formed with the piston cylinder 70 such that vane 126 does not move relatively to revolving piston assembly 68, said vane is also rigidly fixed radially, without operating clearance, in between the cylinder heads 72,74. If necessary, the opposed radial edges 138 and 140 of the vane may be countersunk within the piston heads 72 and 74.

The concept of novel rotary compressor does not utilize a roller as a piston, a reciprocating vane and a vane spring used to press the vane against the roller. The vane of novel compressor does not reciprocate or swing. It means that related operating clearances necessary in prior art rotary compressors for a sliding movement of a vane against stationary walls of a cylinder block and facing surfaces of stationary cylinder heads do not exist in novel rotary compressor. The new compressor design eliminates frictional and leakage losses associated in prior art rotary compressors with the reciprocating movement of the vane against stationary walls of the cylinder block and heads, losses related to "grinding" the roller wall by tip of the vane pressed against the roller by combine force of spring and discharge pressure and losses related to sliding movement of the roller against stationary inner wall of the cylinder block. The relatively minimal frictional losses caused by vane 126 of present invention facilitate the minimization of power losses due to friction.

The use of a vane fixed without clearance to the piston cylinder and piston heads also facilitates the elimination of refrigerant leakage across the sealed barrier formed by vane 126 radial 138, 140 and axial 130 side edges (see FIG. 4), said leakage from a relatively high pressure compression chamber 128 to a relatively low pressure suction chamber 124 during operation of the compressor. Leakage to the suction side through the clearances of the leading semi-cylindrical part 156 of the guide bearing 136 is minimal due to the fact that the part 156 is compressed between the vane 126 flat surface 166 and the bearing seat 168 as a result of a driving force pressure exerted by the rotor block and presence of an intermediate oil film between the mating surfaces (see FIG. 5).

The rotor block and eccentrically fit revolving piston assembly have line rolling contact 121 and are radially pressed against one another to establish coupling friction which will be enough to allow transmission of motion from the rotor block (driver) to the revolving piston assembly (follower). Such coupling creates momentum moving the revolving piston assembly in addition to the basic momentum transferred by the rotor block 108 through vane 126 (coupler). At the contact line 121 (it is the only line of contact between the rotor block and the revolving piston assembly) a sliding motion (slippage) is absent due to the fixed position of the vane and frictional resistance to the rolling motion is substantially smaller than to the sliding motion. It has generally been observed that coefficient of friction reduces on dry surfaces as sliding velocity increases. Docos (Trans. ASME, 1946) measured this reduction in sliding friction for mild steel on medium steel. Values of sliding friction coefficient changed from 0.53 to 0.18 with increase of sliding velocity from 0.0001 in/s to 100 in/s. Values of dry rolling friction, in comparison, for steel rollers on steel plates changed from 0.0005 for surface well finished and clean to 0.005 (versus min. value 0.18 of sliding friction) for surfaces covered with slit. Such difference in the values of the friction coefficient for sliding and rolling motion indicates that the frictional losses at the contact line of the rotor block and revolving piston in their unidirectional rotation will be minimal due to the fact that a possibility of the slippage (sliding friction) has been eliminated and the tangential velocities at the contact line 121 are equal in magnitude. Absence of an operating clearance between the revolving piston and the rotor block at the contact line 121 will also completely eliminate related axial leakage loss from the compression chamber to the suction chamber.

The radial ends 180 and 182 of the rotor block 108 are recessed so as to form around the crankshaft 26 an annular chambers 184 and 186 (see FIG. 4) surrounded by portions of the inner circular wall of the rotor cylinder 88, surfaces 188, 190 of the rotor heads 100, 102 and the adjacent surfaces 192 and 194 of the pistons heads 72 and 74. The outer surfaces of the radial ends 180, 182 of the rotor block are in sliding contact with the facing surfaces of the piston heads. The frictional losses between the surfaces of the rotors block radial ends 180, 182 and facing surfaces 192, 194 of the piston heads will be minimal due to the reduced area of the contact and low relative rubbing speed between synchronously revolving in one direction rotor block and revolving piston assembly. Exclusion of a roller as a piston in the novel rotary compressor, employment of a vane rigidly fixed in the revolving piston eliminates related leakage and frictional losses.

Stationary hollow crankshaft 26 is fixedly (brazing, welding) connected at its small diameter ends 30, 32 to the hermetic housing 22 caps 38, 40 and supports as the rigidly fixed to it motor stator 84, so spinning rotor block 108 and the revolving piston assembly 68. The single structure supporting the motor stator, the rotor block, the revolving piston assembly and housing will simplify assembly of the compressor 20 and allows precision, reliable setting of the motor air gap, concentricity and eccentricity due to the reliable and common single reference—rotor block rotation axial line. The welding operations of the housing parts, such as the end caps, top cylindrical cup and base mounting bracket does not affect established tolerances and aliments due to absence of the direct contact between the compressor pump and the housing and deformation of cylindrical configuration of the housing will not affect assembly settings.

The power supply and control wires located inside of a prior art compressors housing are in proximity to the mowing parts and are subjected to an elevated temperature of a discharge gas-oil mixture passing at high velocity through the motor stator-rotor gap to an outlet. Elevated temperature of gas-oil mixture passing through the air gap, intensive discharge pressure pulsation interfered with motor-rotor rotating at high speed, may greatly increase windage and friction losses, impair performance and provide inadequate cooling of the motor. Such an electric motor operating conditions during long operating cycles will cause overheating of the motor stator winding and can lead to premature motor failure.

According to the present invention, the electrical terminals which carry the circuit through a partition wall 449 of the suction cavity are electrically insulated from the housing and are leak-proof. Most motor terminals generally are fused to glass, in turn, is fused to a metal disk. By reference to FIG. 1, it will be seen that such terminal assembly 450 is welded to the partition wall 449 of the housing surrounding suction input cavity 48. The terminal assembly must be leak-proof after thousands of heating and cooling, expansion and contraction cycles. Mounting of the terminal assembly 450 on the wall of the suction side of the housing is preferable due to the smaller pressure pulsations and lower temperature affecting wall retaining terminal assembly 450 than for assembly on a partition wall of a housing which sealing a high pressure refrigerant, said assembly which is common in prior art rotary compressors.

In addition, conventional rotary compressors use an external electrical circuit which basically includes an electrical terminal carrying the circuit though the housing, a run capacitors, a solid state relay, a thermally operated overload protector, etc. An electrical terminal box secured, as usual, externally to the top or to the circumferential side of the compressor housing which hermetically holding high temperature discharge gas and hot oil, said terminal box used to accommodate some or all of the items specified above. Furthermore, another box—an inverter storage box, is provided on outer circumference of housing for inverter controlled rotary compressors.

The design of the novel rotary compressor made it possible to locate specified above items of the external electrical circuit in the limits of the compressor housing by forming a circular cylindrical storage space 56 adjusted to the wall of the suction cavity 48 and surrounded by circular top cover 60. An O-ring 702 and a circular ring 706 interposing between the compressor housing and top cover 60 decrease transmission of vibration motion from the compressor structure and reduce possibility of sound radiation by top cover. An advantage of such modification is that, after elimination of plurality of external electrical boxes, the compressor is compact (smaller package space), has better configuration, lower manufacturing cost and is more reliable. In addition, the power supply circuit elements are protected from effect of high ambient temperatures, elevated temperature of the compressor housing, moisture, are safer, and elimination of bulky boxes open access to the housing surface areas for painting, thereby avoiding potential oxidation and rust. Furthermore, the close proximity of the cylindrical storage cavity 56 to the cool wall of the suction cavity 48 makes it convenient for compressors utilizing inverters to arrange cooling of power semiconductor modules. A heat generated from the power semiconductor switching elements of the module can be efficiently released from the heat-dissipating surface via the suction cavity 48 wall to the low-temperature refrigerant gas flowing inside. Therefore, the power semiconductor switching elements are cooled more efficiently, and hence, the heat load of the power semiconductor switching elements can be reduced.

Another advantage of present invention is that such components as an internal ran of power supply wiring, the motor compartment 90 with the stator 84, which is separated by the air gap 87 from external rotor 86, are on the suction side of the compressor (see FIG. 4). An inside wire terminals 451 are spring clips that tightly grip the hermetic terminals. The hollow part of the crankshaft 26, denoted below as the suction channel 196, is used also as a conduit for power supply wires and wires controlling operation of the electric motor, so for delivery of suction gas. The power to the stator windings 236 is supplied by the wires 452 running from an inner part of the hermetic terminals 454, through a part of the suction channel 196 where wires are supported by insulators 456, 458 located above the stator 84. The openings 460 and 462 machined in the crankshaft 26 (see FIG. 12) must have smoothed, well rounded edges so that the covering of the wires will not be abraded while the wire pulled in. The insulators 456 and 458 are also protected wires from abrasion triggered by movement of the wires due to vibration at start, stop and operation of the compressor. Such arrangement of power delivery to the motor will prevent wiring from interference with the compressor rotating parts, action of intensive discharge pressure pulsations, high temperature, oil and chemically aggressive substances.

The suction system of the novel rotary compressor comprises, in combination, the suction input cavity 48 which is an integral part of the compressor housing 22, the motor compartment 90 which is in fluid communication as with the suction input cavity 48 through the suction channel 196 formed inside of the crankshaft 26, so with the suction chamber 124 by means of a plurality of channels 198 formed vertically in the wall of the rotor block. A suction inlet tube 200, which is rigidly supported outside the housing by an eye hook 700 and hermetically fixed to the wall of the suction input cavity 48, directs a vapor-liquid mixture of refrigerant and lubricating oil through a screen 202 (to filter the impurities) into the inner volume of the suction input cavity 48, where gas flows to the top and the liquid collects (due to gravity) above the upper end cap 38 separating a high pressure side 204 below the cap 38 and a low pressure side 46 of the housing (see FIG. 4). An open end 210 of the stationary crankshaft 26 suction channel 196 has been located close to the top of the suction input cavity 48 and at the level above the suction inlet tube 200 to prevent liquid from entering directly into the suction channel 196. The heat generated by high side 204 discharge gas will be transferred trough the upper end cap 38 to the liquid collected at the bottom of the suction cavity 48 and will significantly accelerate a vaporization process. A metering aperture 206 in the wall of the crankshaft located vertically at the point slightly above the bottom of the suction cavity 48 helps to return compressor oil to a circulation and prevents penetration of the hard particles collected at the wall due to the gravity. The metering aperture 206 is placed slightly above a bottom of the suction input cavity 48 to prevent penetration to the motor compartment 90 of any hard particles collected at the bottom due to gravity. The gas to be compressed is drawn into the motor input cavity 90 centrally through a hollow in crankshaft 26 and, further, is flows outwardly through a plurality of machined in crankshaft radial openings 212, (see FIGS. 1, 12), located below stator 84 laminations, across stator windings 214 to cool them and other components of the electric motor 66.

Figure 3F:
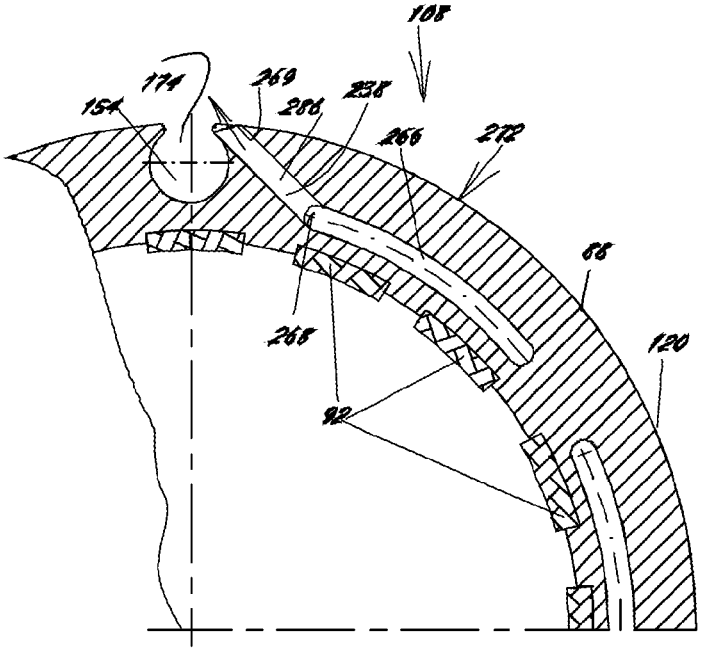
FIG. 3F is a sectional view of the rotor block of FIG. 3 along line C-C with top mounted impeller.
Figure 3F:
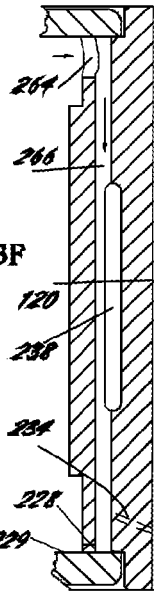
Figure 3E:
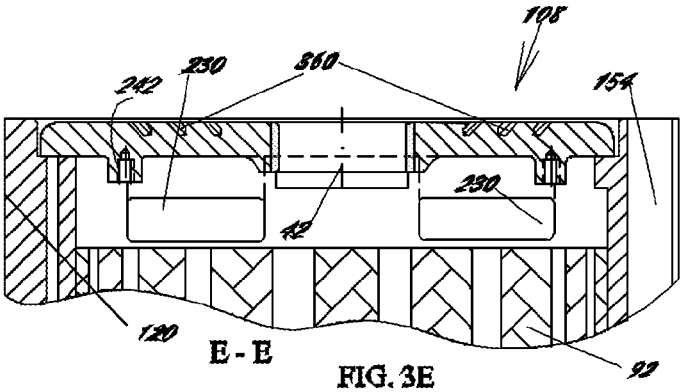
FIG. 3E is a sectional view of the rotor block of FIG. 3 along line E-E.

The suction gas, which has been partially separated from lubricant and the liquid refrigerant in the input cavity 48, accumulates in the cavity 216 spaced below the stator 84 (see FIG. 1), and will be further forcibly separated from oil and liquid by action of centrifugal force developed by rotation of the rotor block 108. The heavier droplets of oil and liquid move radially outwards, thus becoming separated from the vapor which flows, consequently, through a plurality of openings 218 below the stator, a plurality of the vertical channels 198, and plurality of openings 230 to the cavity 232 spaced above the stator 84 lamination. Some quantity of the suction gas, to be derived through the motor air gap 87 to the upper cavity 232, is also completely free from the lubricant and liquid refrigerant, has low pressure pulsations and temperature and will not adversely affect magnetic field of the motor. The oil collected in the cavity 216 is urged under pressure, developed due to the centrifugal force, against the inner wall of the rotor block 108 and flows through an opening 228 and a metering aperture 234 into the suction chamber 124 (see FIG. 3F). The metering aperture 234 is placed above an inner bottom part 229 of an annular chamber 186 (see FIG. 4) to prevent penetration to the suction chamber 124 of any hard particles collected at the wall below the metering aperture due to the gravity and action of the centrifugal force. This dual stage of vapor-liquid separation process and purge of the refrigerant from the hard particles drastically reduces the likelihood of slugging, increases capacity of the compressor and improves reliability.

The openings 230 are formed circumferentially in the wall of the motor compartment 90 so that the incoming vapor flowing through these openings and through the motor air gap 87 cools as the stator windings 236 having a plurality of stator conductors located at a stator core, so another parts of the external-rotor motor 66.

Figure 5:
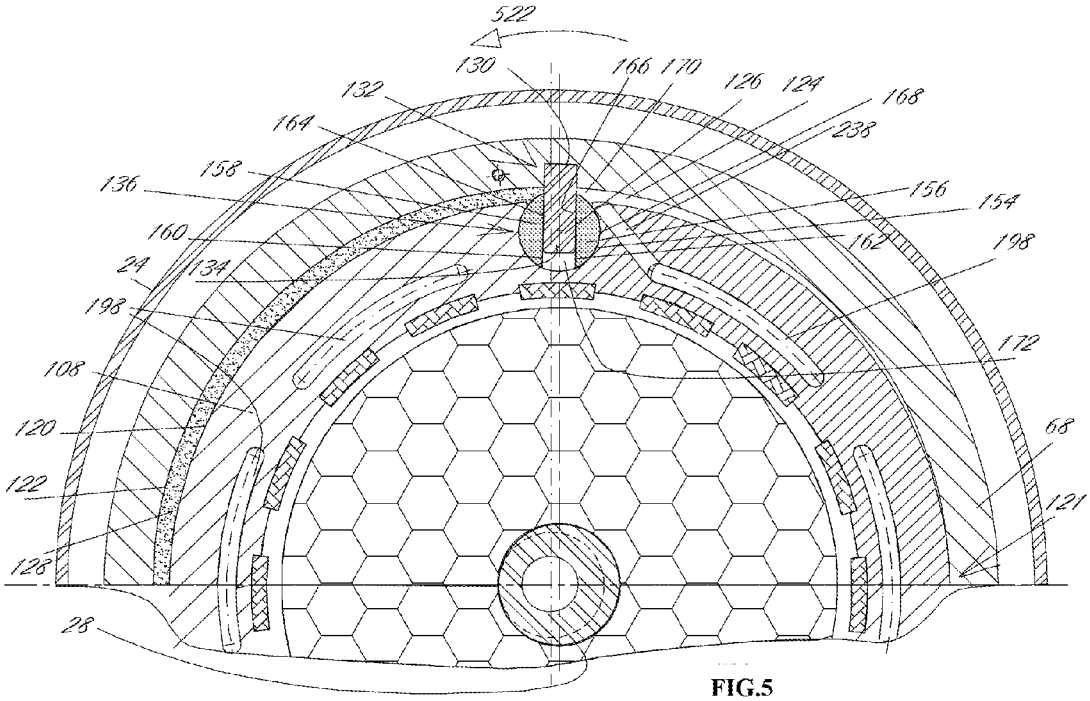
FIG. 5 is an enlarged fragmentary sectional view of the vane assembly of FIG. 4 along line I-I.
Figure 6:
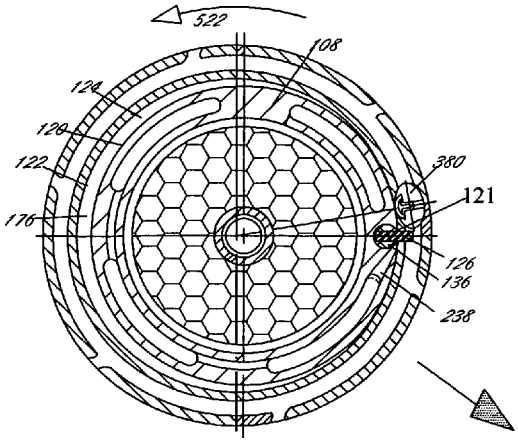
FIGS. 6, 7, 8, and 9 are diagrammatic sectional views showing the position of the compressor pump parts at some stages of the operating cycle.
Figure 7:
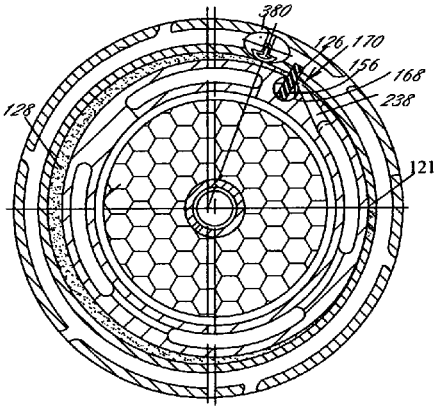
Figure 8:
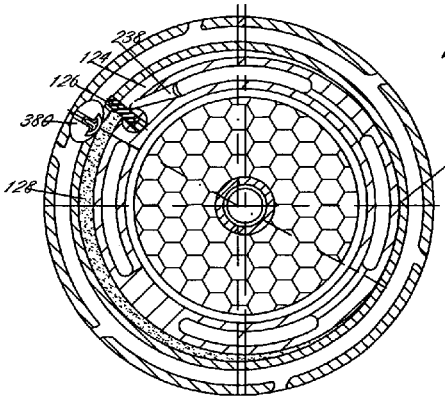
Figure 9:
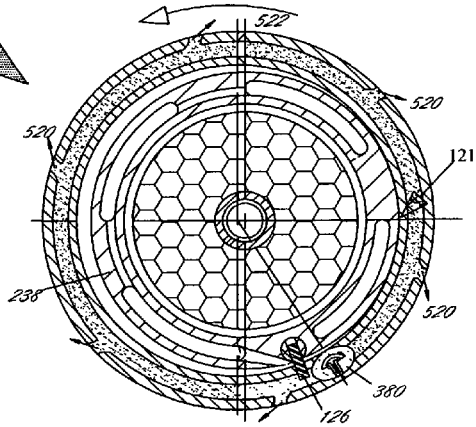
Figure 10:
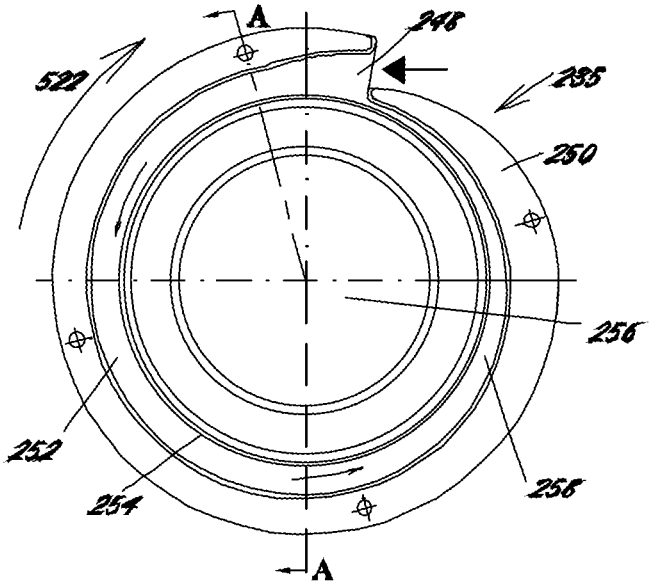
FIG. 10 is a top view of a scroll impeller.
Figure 10A:
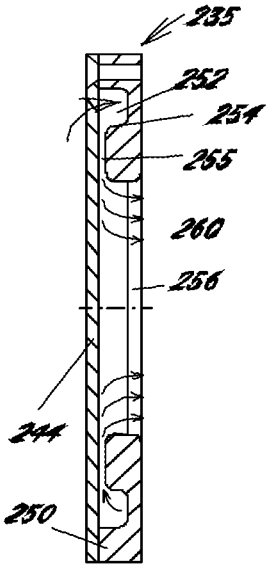
FIG. 10A is a sectional view of the scroll impeller of FIG. 10 along line A-A.

As can observed in FIGS. 1 and 5, an impeller 235, spaced in the cavity 232, generate higher pressure suction gas and supercharge it in the suction chamber 124 through a suction port 238. The impeller 235 is rigidly fixed by socket screws 240 to the protrusions 242 of the rotor head 100 without clearance between a partition circular plate 244 and inner cylindrical wall 246 of the rotor block 108 and rotates simultaneously with the rotor block due to a rigid connection. The partition circular plate 244 has an opening for admission of the suction vapor. The impeller consists of an intake nozzle 248 (see FIGS. 10, 10A) located at outer edge of the constant height scroll 250, a channel 252 which, in combination with outer wall 254 of the output opening 256 and partition circular plate 244 constitutes the diffuser 258. During rotation of the rotor block 108 the intake nozzle 248 scoops up the suction vapor, rises its velocity, increases pressure of the flow streaming out of the channel 252 diffuser 258 and sends an increased pressure suction vapor in the direction marked by arrows 260, as can be observed in FIG. 1. The flow is led toward located above the impeller 236 space 262 which is in fluid communication with the suction chamber 124 by means of, consequently, an opening 264, a channel 266, and the slot 268 of suction port 238, an output 269 of which is formed axially at the middle portion of the rotor block 108 external wall 120 in close proximity to the cylindrical aperture 154 (see FIGS. 3A, 3D, and 3F).

Figure 11:
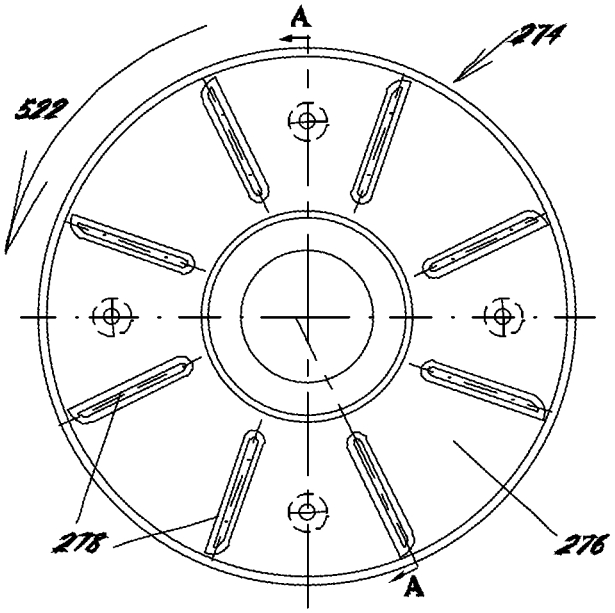
FIG. 11 is a top view of the impeller with radial blades.
Figure 11A:
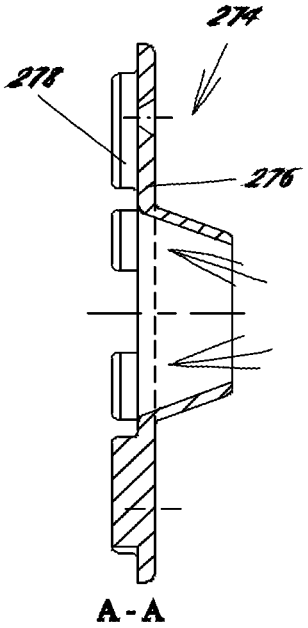
FIG. 11A is a sectional view of the radial blades impeller of FIG. 11 along line A-A.

Another embodiment of an impeller is represented in FIGS. 4, 11, 11A wherein it can be observed that a centrifugal type impeller 274 comprised of a disk 276 which carried blades 278 have been used to supercharge the suction chamber. The impeller 274 is spaced in the cavity 216 located below the stator 84 and is rigidly fixed by socket screws 275 to the protrusions 280 of the rotor block head 102. A suction gas flows from the suction input cavity 48 to the space 282 below the disk 276 and the impeller 274, which rotates simultaneously with the rotor block 108, distributes an increased pressure suction vapor through, consequently, plurality of openings 218, a plurality of the vertical channels 198, and openings 230 to the cavity 232 spaced above the stator 84 lamination. The oil separated from the suction gas by the centrifugation will be forcibly guided to the mitering (bleeding) aperture 234 which has been formed in the side wall of the rotor block. (see FIGS. 3, 3A, 3C). The metering aperture 234 is placed above an inner bottom part 229 of an annular chamber 186 to prevent penetration to the suction chamber 124 of any hard particles which will be collected at the wall below the metering aperture due to the gravity and action of the centrifugal force. The suction chamber 124 will be supercharged with vapor distributed through the openings 218 and 230 (see FIG. 3E) of the vertical channel 266 adjacent to the suction port 238.

Compressor 20 is also provided with a lubricating oil flow path through which oil accumulated in the oil sump 300 is directed to the compressor components. Referring to FIGS. 4 and 14 through 17, located in the lubrication flow path is positive displacement, reciprocating piston type oil pump 302 assembled in the integral oil pump-thrust seat block 408 which is mounted, as described above, on the stationary crankshaft 26 below the compressor pump 64. The oil pump holder 409 has finely machined dead end elliptical shaped barrel 332 formed with an oil input port 304 and an oil discharge channel 306. Piston 308 has substantially elliptical configuration portions 310, 312 as shown in FIG. 15A, to be received in elliptically shaped barrel 332 (see FIG. 16). Piston reciprocates within barrel 332 to induce pumping action of the oil pump 302 and elliptical configuration of the mating parts prevents rotation of the piston around its axis. Piston 308 includes enlarged elliptical portions 310, 312 (see FIG. 15A), each having major and minor axial dimensions necessary to establish clearances for reciprocating movement of the piston in the barrel 332. Piston 308 is provided with axial channel 314 connecting bottom cavity 316 with semispherical top cavity 318 so, that both cavities are in fluid communication (see FIG. 15B). A cylindrical portion 320 of the piston is spaced between the enlarged elliptical parts 310 and 312 and has diameter which is smaller than a size of the minor axis of the elliptical parts. A port 322 formed in the cylindrical part 320 is in fluid communication with axial channel 314. The port 322 may be formed by an elongated slot extending substantially parallel to the longitudinal axis of piston 308. The elliptical shape portion of the piston prevents axial rotation and the port 322 is always aligned with an input opening 305 of the discharge channel 306 (see FIGS. 14 and 16A).

Referring now to FIGS. 4 and 14, reciprocating movement of piston 308 is provided by the rotation of the compressor pumps 64 revolving piston assembly 68 which serves as a driving link and which imparts motion to a driven link (follower)-piston 308. The firmly attached to the revolving piston assembly 68 piston head 74 is formed with segmental shaped circular groove 324 which has variable depth and is coaxial with the head 74. During 360° rotation of the head 74 around the stationary crankshaft 26 the axially changing depth of the circular grove 324 imparts reciprocating motion of the follower—piston 308. The piston head 74 acts as a cam, which communicates motion to follower or piston 308 through a roller or a ball 326 located in semispherical cavity 318 (see FIG. 14). The ball 326 slides in the vertically variable depth groove 324 formed in the outer surface of revolving piston head 74 facing the integral oil pump-thrust seat block. A conical compression spring 328 is interposed between an end 336 of the oil pump barrel 332 and a spring supporting flange structure 330 defined at an end 334 of the piston 308 to keep the ball 326 in constant contact with the grove 324 segmental surface. The oil pump holder 409 has recess 336 used as a seat for the tapered O.D. conical spring 328 which has short solid height when compressed. An end chamber 338 (see FIG. 14) of the oil pump barrel 332 is in fluid communication with the oil input port 304 and oil is stored in the end chamber 338 due to location of the port below an oil surface level 340 of the oil sump 300. The reciprocating movement of piston 308 causes the volume of chamber 338 defined in barrel 332 between its end 346 and end 348 of piston 308 to vary, enabling pumping of the lubricating oil. As piston 308 moves upwardly, the sealed relationship between inner elliptical surface 350 of barrel 332 and the outer perimeter of enlarged portion 310 creates a vacuum which draws lubricant from oil sump 300 through input port 304 and into chamber 338. As piston 308 moves downwardly, spring element 328 is compressed and, oil is forced out of chamber 338 and flows upwardly through semispherical cavity 316, axial passage 314 and the port 322 into discharge channel 306. The oil discharge channel 306 is in fluid communication with axially extending channel 342 formed in crankshaft 26 via reservoir 344 (see FIG. 4) so, the oil from discharge channel 306 then flows, consequently, into reservoir 344, axially extending channel 342 in shaft 26 and through plurality of oil passages 352 to lubricate the compressor bearings. After the down-stroke of piston 308 is complete, the piston moves upwardly within pump barrel 332 under the force of spring 328, reducing the amount of pressure acting on oil remaining in chamber 346 and allowing additional oil to be drawn into chamber 338 to repeat the lubricating process.

A portion of the oil flowing from chamber 338 toward oil discharge channel 306 travels upwardly into passage 354 (see FIG. 14). Lubricating oil from oil sump cavity 300 is supplied through passage 354 and semispherical cavity 318 to the surfaces of the ball 326 to reduce friction there between. As ball 326 rotates, oil from passage 354 is carried on the outer surface thereof to lubricate the interfacing surfaces between ball 326 and grove 324.

The location of the pumping chamber 338 and oil inlet 304 being below oil level 340 in the sump cavity 300 prevents formation of "gas lock" conditions. Such a condition might otherwise occur when the piston element cycles normally, but oil cannot be pumped because there is gas captured in chamber 338. Piston movement would then merely cause compression and expansion of the gas within pumping chamber 338, and thus no oil would be pumped to the bearing surfaces.

In some compressors, lubricating oil tends to drain away from bearing and mating surfaces upon shutdown of the compressor. Upon startup of the compressor, there may be some delay before oil can be resupplied to the bearings from the oil sump. In order to prevent the lubrication delay, compressor 20 is provided with reservoir 344, as shown in FIG. 4, defined as a peripheral annular recess in the shaft 26 surrounded by the inner surface of aperture 418 of oil pump holder 409. Formed in such way a reservoir 344 is a hollow cylindrical cavity spaced between the oil pump discharge channel 306 and vertically extended bore 342. The oil supplied by the pump flows, consequently, through the reservoir 344, vertically extended bore 342 above and a plurality of passages 352 to lubricate bearings.

The lubricant is supplied also to the annular chambers 184, 186 and through a passage 356 thus to a portion of axial slot 172 in which the vane 126 is disposed. During operation of the compressor the lubricant delivered into the annular chambers 184,186 and axial slot 172 is thrown outward by centrifugal force to form annular seal of liquid at the periphery of annular chambers 184, 186 and along the axial edges 134 of the vane 126 (see FIGS. 4, 5). Any leakage that may take place past the sides of the vane 126 or past the ends 180,182 of the rotor block 108 will be leakage of the lubricant inward into the crescent-shaped space 176, as this lubricant is under combine pressure of the discharge gas, the oil pump delivery pressure and the pressure developed by centrifugal force. By this means therefore leakage of the fluid to be compressed past these relatively moving members will be prevented and at the same time a bath of lubricant will be provided in between mating parts. The oil accumulated in the axial slot 172 of the vane 126 will also lubricate and simultaneously prevent leakage of the fluid to be compressed past relatively moving surfaces and will be discharged during narrowing of the slot 172 through the vanes 126 radial passages 358 which are in fluid communication with inner space 125 of the housing 22 containing oil sump 300 at the bottom.

Upon shutdown of the compressor, the oil delivered into the annular chambers 184, 186 during compressor operation, will be partially trapped in a plurality of the circular groves 360 and 362 (see FIGS. 3E and 4), and rest of it, combined with the oil in the vertically extended bore 342, will flow down, due to the gravity, and deposited in the reservoir 344, discharge channel 306, and chamber 338. The reservoir 344 is also in fluid communication with the compressor oil sump 300 through aperture 301 (see FIGS. 4, 16, and 17) equipped with unidirectional check valve 303. The Lee Company produces miniature check valves, one of which can be used for this purpose. The check valve is closed due to the pressure difference in between the pressure of oil delivered by the pump and pressure in the cavity of the oil sump during operation of the compressor. After shut down of the compressor the check valve opens due to equalization of pressure and oil will flow from the oil sump 300 through the aperture 301 into reservoir 344. It is an additional protective measure against formation of "gas lock" conditions. Upon compressor startup there is no "gas lock" condition due to continues availability of the oil in the chamber 338, discharge channel 306, and reservoir 344. The oil trapped in plurality of the circular groves 360, 362 will be immediately delivered upon compressor startup (due to the developed centrifugal force) to the mating surfaces of the rotor block 108 and revolving piston assembly 68 to lubricate and form an annular seal preventing leaks.

During compressor operation electrical current supplied to stator 84 via a terminal assembly 450 creates a magnetic flux which in turn causes rotation of external rotor block 108 around stationary crankshaft 26. The rotation of rotor block 108 triggers the simultaneous rotation of eccentrically offset revolving piston assembly 68 about crankshaft 26, said rotation transmitted through guide bushing 136—vane 126 coupling in which vane 126 is rigidly fixed to piston cylinder 70 (or integrally formed with the piston cylinder 70) and guide bushing 136 is swaying in aperture 154 of roller block 108. Referring to FIGS. 5 and 7 through 9, as rotor block 108 rotates the volume of the suction chamber 124 becomes progressively larger, and the volume of the compression chamber 128 becomes progressively smaller. Suction port 238 is in communication with suction chamber 124 and discharge passage 382 is in communication with compression chamber 128 throughout an entire 360 degree rotation of rotor block 108 and revolving piston assembly 68 about stationary crankshaft 26. During progression of the operating cycle refrigerant and oil is drawn into suction chamber 124 through suction port 238. As compression chamber 128 decreases in volume, the high-pressure mixture of refrigerant and oil is expelled once the pressure within compression chamber 128 is sufficient to open the discharge port.

Figure 2C:
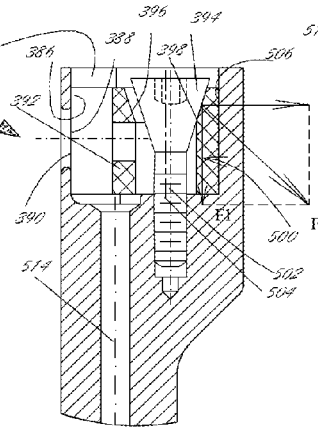
FIG. 2C is an enlarged fragmentary view of the discharge valve assembly of FIG. 2B.
Figure 2D:
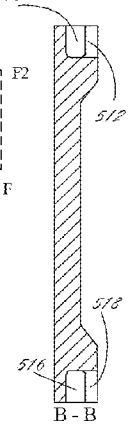
FIG. 2D is an additional sectional view of the piston cylinder of FIG. 2 along line B-B.

Referring to the drawings and more particularly to FIGS. 2 through 2D, the discharge system of novel rotary compressor comprising generally a discharge valve assembly 380 with a discharge valve member 390 disposed in a discharge valve cavity 384 formed in the rim 80 of the piston cylinder 70. The discharge valve cavity 384 provides fluid communication between the compression chamber 128 and a discharge expansion cavity 510 which is circumferentially formed in the rim 80 of the piston cylinder. A valve retainer with a mounting screw is surrounded by the valve member spaced in the discharge valve cavity.

As assembled for operation, the novel rotary compressor utilizes two similar discharge system branches as best seen with reference to FIG. 1, which are in fluid communication trough plurality of axial apertures 514, connecting discharge gas expansion cavity 510 of end 80 with the discharge gas expansion cavity 516 formed in the end 82 of the piston cylinder 70. It is possible to use one or a plurality of such discharge system branches in the invented compressor, so description is related to a single one.

The elliptically shaped discharge valve cavity 384 has a valve front seat surface 386 defining a discharge port 388 and the valve rear seat surface 500. The thin-walled tubular (cylindrical) valve member 390 has O.D. larger than a minor diameter of elliptical cavity. Upon insertion into elliptically shaped discharge valve cavity, the cylindrical discharge valve member 390 biased into engagement with a valve front seat surface 386 by spring force developed due to the difference in diameters, to thereby seal the discharge port.

A valve retainer 392 is used to secure discharge valve member 390 in predetermine position and limit its radial movement to prevent overstress and to reduce travel distance and timing of discharge valve member. Valve retainer 392 and valve mounting screw 394 have, respective, angled (conical) surfaces 396, 398 which are generally parallel. The axial line 502 of valve mounting screw 394 is offset radially from the position of the valve retainer 392 axial line 500, therefore, as interfacing axial conical surfaces 396, 398 are forced into closer proximity by the tightening of valve mounting screws 394, increasing compressive forces are brought to bear between angled surfaces (see FIG. 2C). The actuating force F developed during tightening of the mounting screw has two components: F1 which move retainer down and F2 which move retainer 392 radially toward the rear seat surface 500. The part of the valve member 390 spaced between retainer 392 external wall 506 and valve rear seat 500 is tightly clamped between the engaged surfaces. In this way, valve member is securely fastened in the discharge valve cavity 384.

When the fluid pressure within compression chamber 128 exceeds the pressure necessary to overcome the biasing spring force of the pre-stressed during assembly valve member 390, latest will travel to position 508 and refrigerant will be discharged from compression chamber 128 through discharge passage 382 and discharge port 388. The discharge valve member of the valve assembly 385, mounted in the piston cylinder end 82 below, will open discharge port simultaneously with the opening of the port 388. The discharged gas flows then through discharge valve cavities 384 and 387, the circumferential discharge gas expansion cavities 510 and 516, formed in the end faces 80 and 82 of the piston cylinder 70, and jet ejected tangentially from the sides of the revolving piston assembly through plurality of nozzles 512 and 518 (see FIGS. 2 and 2D) into the interior of the housing 22. The discharge gas, ejected tangentially through the nozzles 512, 518 in form of plurality high speed jets in the direction 520 opposed to the direction of rotation 522 (see FIG. 2, 2D,), produces angular momentum or torque about stationary crankshaft 26 axis which has been exerted by combine reaction forces of jets. Such supplemental angular momentum will, definitely, positively affect rotation of the cylinder block and reduces load of the compressor motor.

What is claimed is:

1. A hermetic revolving piston rotary compressor, comprising, in combination:

a housing defined by a cylindrical main body portion, an upper and a lower cap interposed and fixedly secured to opposite ends of said cylindrical main body portion to form a high pressure side portion of said housing, a base mounting bracket fixedly attached to said lower cap, and a top cylindrical cap whose open end is fixedly secured to a cylindrical projection of said upper cap to form a suction input cavity, said upper cap and said lower cap each having a circular central aperture;

a stationary crankshaft, said stationary crankshaft having an eccentric integrally formed therein, an upper end and a lower end, said lower end of said stationary crankshaft being fixedly secured in said circular central aperture of said lower cap and said upper end of said stationary crankshaft being fixedly secured in said circular central aperture of said upper cap to sealingly separate said high pressure side portion from said suction input cavity, said upper end of said stationary crankshaft extending through said circular central aperture of said upper cap into said suction input cavity, said stationary crankshaft having a longitudinal channel opened at a top of said upper end positioned in said suction input cavity;

an oil containing sump being disposed in an interior of said high pressure side portion of said housing;

a motor having a stator and an external rotor, said stator being permanently fixed to said eccentric of said stationary crankshaft, said external rotor surrounding said stator and comprising a rotor cylinder whose housing inner wall has a plurality of permanent magnets evenly spaced by an air gap from a facing surface of said stator to form a brushless external rotor motor, said rotor cylinder being rotatably mounted on said eccentric of said stationary crankshaft via lower and upper rotor heads each having a central projection equipped with a bearing and a flange portion being circumferentially detachably fixed to opposite ends of said rotor cylinder, whereby a rotor block is formed, said rotor block housing a motor compartment;

a revolving piston assembly having a piston cylinder with a coaxial cavity whose diameter is larger than an external diameter of said rotor block, said piston cylinder surrounding said rotor block and fitted eccentrically to the rotor block without radial operating clearance, said piston cylinder being rotatably mounted on said upper and lower ends of said stationary crankshaft via lower and upper piston heads each having a central projection equipped with a bearing and a flange portion being circumferentially detachably fixed axially to opposite ends of said piston cylinder to form said revolving piston assembly which houses said rotor block, thereby forming a compressor type pump;

a working cavity defined as a crescent shaped space formed between an external periphery of said rotor block and an internal surface of said revolving piston assembly due to difference in diameter and eccentric positioning of said piston and rotor cylinders;

a vane which is formed integrally with said piston cylinder, said vane being projected radially inwardly from a surface of said coaxial cavity of the piston cylinder to partition said working cavity into a suction chamber which is in fluid communication with said motor compartment via a suction port, said suction chamber with said suction port positioned on one side of said vane and a compression chamber communicating through a discharge port of a discharge valve assembly formed in a rim of said piston cylinder, said compression chamber and said discharge valve assembly positioned on opposed sides of said vane which does not slide or swing relative to said revolving piston assembly;

a guide bushing which is disposed in a cylindrical aperture extending longitudinally in the wall of said rotor cylinder, said cylindrical aperture having an axis parallel to an axis of said rotor block rotation, said guide bushing supporting said vane in such a manner that when said rotor block is rotated, said revolving piston assembly will be driven simultaneously by the interaction of said vane upon said guide bushing which drives said revolving piston assembly by virtue of its bearing seat in said cylindrical aperture where said guide bushing will oscillate to allow for change in angular position of said vane when said rotor block and said revolving piston assembly are rotated in the same direction:

an internal suction system which consists of a low pressure side portion of the housing being in fluid communication through said longitudinal channel in the stationary crankshaft with said motor compartment which, consequently, is in fluid communication with said suction chamber through said suction port;

a discharge system comprising said discharge valve assembly with a discharge valve member disposed in a discharge valve cavity formed in the rim of said piston cylinder, said discharge valve cavity providing fluid communication between said compression chamber and a discharge expansion cavity which is circumferentially formed in said rim of said piston cylinder, a valve retainer with a mounting screw, said valve retainer surrounded by said valve member disposed in said discharge valve cavity;

a thrust bearing block being securely mounted above said compressor type pump on said upper end of said stationary crankshaft with a thrust seat of said thrust bearing block being biased into engagement with a thrust surface of said bearing fixed in said central projection of said piston upper head to support and limit axial movement of said compressor type pump;

an integral oil pump —thrust seat block being securely mounted on said stationary crankshaft's lower end below said compressor type pump with another thrust seat being biased into engagement with a thrust surface of said bearing fixed in the central projection of said piston lower head to support and limit axial movement of said compressor pump, said integral oil pump —thrust seat block having a holder comprising an axial aperture to accommodate said stationary crankshaft's lower end during assembly, a dead end barrel housing an oil pump piston, said barrel formed with an oil input port and oil discharge channel, said integral oil pump —thrust seat block partially submerged in said oil containing sump.

2. The rotary compressor of claim 1, wherein a lubrication flow path is formed by fluid communication between said dead end barrel of said integral oil pump-thrust seat block, an oil reservoir formed by annular recess in said stationary crankshaft formed with a longitudinal extending bore having a radial passages to distribute oil to the bearings and annular chambers spaced radially at axial ends of said rotor block, said annual chambers being in fluid communication with said cylindrical aperture housing said guide bushing supporting said vane having bored through radial passages arranged to return oil to said oil containing sump.

3. The rotary compressor of claim 1, wherein axial ends of said rotor block are recessed so that only surfaces of said rotor block's outer rims are in a sliding contact with facing walls of the piston heads and designed such that annular chambers are used to distribute lubricant to said sliding contacts, said annular chambers having a plurality of coaxial circular pockets formed in their bottom surfaces, said pockets which in combination with said oil reservoir will accumulate oil upon shutdown of the compressor, said oil which upon startup will be thrown by centrifugal force toward a sliding contact area and will provide lubrication and also form an annular liquid seal at a periphery thereof, wherein sealing pressure of said liquid seal is a combination of —discharge pressure, pumping pressure and centrifugal force pressure.

4. The rotary compressor of claim 1, wherein an oil reservoir is in fluid communication with an oil delivery longitudinal bore in said stationary crankshaft having an oil pump holder with a radial aperture being equipped with a unidirectional check valve, said unidirectional check valve regulates delivery of oil to said oil reservoir from said oil containing sump to prevent formation of "gas lock" conditions.

5. The rotary compressor of claim 1, wherein said dead end barrel and oil pump piston of said oil pump-thrust seat block are shaped elliptically to prevent rotation around an axis of said piston having, a bottom cavity, a top semispherical cavity, an axial piston aperture connected to both cavities, said axial piston aperture being interrupted by an elongated slot which is in fluid communication, successively, with said oil input port, said axial piston aperture and said oil discharge channel which are in fluid communication with an oil reservoir formed by an annular recess in said stationary crankshaft.

6. The rotary compressor of claim 1, wherein said oil pump piston further comprising a ball placed in a top hemispherical cavity of said oil pump piston, a conical compression spring interposed between said barrel and top of said oil pump piston, said spring keeping said ball placed at the top of the piston in constant contact with a vertically variable depth circumferential groove formed in the outer surface of said piston lower head which during 360° rotation acts as a cam and imparts reciprocating motion to a follower of said oil pump piston.

7. The rotary compressor as defined in claim 1, wherein cavities below and above said stator disposed in said motor compartment, are in fluid communication with said motor air gap through channel means for directing flow coming from said low pressure side portion of the housing, said channel means consisting of a plurality of longitudinal channels formed in said wall of said rotor cylinder and directed substantially parallel to the axis of rotation of said rotor block, said channels having in said wall openings disposed below and above said stator and facing an interior of said motor compartment.

8. The rotary compressor as defined in claim 1, wherein a vapor-liquid mixture entering said internal suction system will undergo a double-stage process of the vapor-liquid separation—first in a suction input cavity due to a difference in gravity and second in said motor compartment due to action of centrifugal force triggered by rotation of said rotor block, before the vapor portion is supercharged in said suction chamber by an impeller rigidly fixed to said rotor block.

9. The rotary compressor as defined in claim 1, wherein oil contained in the liquid part of a vapor-liquid mixture is delivered to said suction chamber through a first oil metering aperture disposed in said suction input cavity and then through a second oil metering aperture located in said motor compartment, both of said first oil metering aperture and said second oil metering aperture being placed above level of adjacent bottoms to prevent penetration of hard particles collected at the wall due to gravity and centrifugal action into said suction chamber.

10. The rotary compressor of claim 1, wherein said rotor cylinder and said piston cylinder are mounted eccentrically, without an operating clearance at a contact line, said piston cylinder being firmly pressed radially against said rotor cylinder and fixed at this position during assembly of said compressor pump to establish coupling friction necessary for transferring a supplemental angular moment from said rotor block to said revolving piston assembly and to eliminate leakage from said compression chamber to said suction chamber.

11. The rotary compressor of claim 1, wherein said discharge assembly comprises, in combination, an elliptically shaped discharge valve cavity with a front valve seat surface accommodating said discharge port and a rear valve seat surface, a tubular valve member disposed in said discharge valve cavity, said valve member having outer diameter that is larger than a minor diameter of said elliptically shaped discharge valve cavity, said tubular valve member surrounding said valve retainer which is cylindrically shaped, said valve retainer and said valve mounting screw both having respective conical shaped portions, said mounting screw having an axial line which is radially offset from a parallel axis of said valve retainer.

12. The rotary compressor of claim 1, wherein said valve member, upon insertion into an elliptically shaped discharge valve cavity, is biased into engagement with a front valve seat by spring force developed due to a difference in diameters, to thereby seal said discharge port, said valve member being disposed in between said valve retainer and a rear valve seat and clamped between engaged surfaces as tightening of said valve mounting screw proceeds.

13. The rotary compressor of claim 1 in which said discharge assembly is arranged so that during a discharge stage of a cycle said discharge port will be open and said valve member's front concave surface cooperates with a concave elliptically shaped front seat surface to form a radial diffuser for refrigerant passing through said discharge port whereby refrigerant flow turbulence and valve flutter are reduced.

14. The rotary compressor of claim 1, wherein during a discharge stage of a cycle a back side of said discharge valve member facing said discharge port has only a line contact with said valve retainer which is cylindrically shaped and a completely open concave surface of said back side is affected by the discharge gas pressure which in combination with a spring force of said discharge valve member will accelerate the discharge port closure.

15. The rotary compressor of claim 1, wherein said discharge expansion cavity having thereon a plurality of reaction nozzles disposed remote from said stationary crankshaft.

16. The rotary compressor of claim 1, wherein said discharge expansion cavity having thereon a plurality of circumferentially fixed nozzles projected outwardly from an inner volume of said discharge expansion cavity to an external perimeter of a side wall of said piston cylinder that is rotatably mounted on said stationary crankshaft, said nozzles having fluid discharge passageways therein inclined opposite to the intended direction of rotation of said piston cylinder such that the reaction force resulting from the nozzle fluid discharge assists in the rotation of the piston.

17. The rotary compressor of claim 1, wherein a high pressure fluid, being distributed from said compression chamber to said discharge expansion cavity, is routed to circumferentially fixed nozzles and ejects from outlets of discharge passageways of said nozzles outwards so that jets of said high pressure fluid from said outlets of said nozzles impart to said revolving piston assembly a driving moment that causes rotation thereof relative to said stationary crankshaft, said driving moment being supplemental to momentum transferred from said rotor block to said revolving piston through said vane and a supplemental angular moment due to absence of an operating clearance at a contact line between an inner periphery of said piston cylinder and external surface of said rotor cylinder.

18. The rotary compressor of claim 1 further including an external storage within limits of said compressor housing and adjusted to a periphery of a wall of said low pressure side portion of the housing, said external storage having a protection cap assembled at the top of said compressor housing with circular vibration damping rings interposed between said protection cap and mating surfaces of said compressor housing, said external storage housing an external part of an electrical terminal or control devices or both, and eliminates necessity to have plurality of bulky external electrical boxes attached to a circumference of said high pressure side portion of the compressor housing.

19. The rotary compressor of claim 1, wherein components of said compressor type pump selected from: an internal run of power supply wiring, said stator, said plurality of permanent magnets, an electrical terminal and control devices, are disposed on said low pressure side portion of the housing or externally in close proximity to said low pressure side portion of the housing which has relatively lower temperature and pressure pulsations compared to said discharge side portion of the housing.

20. The rotary compressor of claim 1, wherein said longitudinal channel of said stationary crankshaft is used as a conduit for an internal run of power supply wiring and wires controlling operation of said external rotor motor, wherein during delivery of suction gas to said motor compartment, suction gas flow to the suction chamber cools said external rotor motor disposed in said motor compartment.

* * * * *